US009905919B2

(12) United States Patent
Sayama et al.

(10) Patent No.: US 9,905,919 B2
(45) Date of Patent: Feb. 27, 2018

(54) ANTENNA, ANTENNA DEVICE, AND WIRELESS DEVICE

(71) Applicant: Asahi Glass Company, Limited, Chiyoda-ku (JP)

(72) Inventors: Toshiki Sayama, Chiyoda-ku (JP); Ryuta Sonoda, Chiyoda-ku (JP); Koji Ikawa, Chiyoda-ku (JP)

(73) Assignee: Ashai Glass Company, Limited, Chiyoda-ku (JP)

( * ) Notice: Subject to any disclaimer, the term of this patent is extended or adjusted under 35 U.S.C. 154(b) by 44 days.

(21) Appl. No.: 14/960,967

(22) Filed: Dec. 7, 2015

(65) Prior Publication Data

US 2016/0087334 A1 Mar. 24, 2016

Related U.S. Application Data

(63) Continuation of application No. PCT/JP2014/066334, filed on Jun. 19, 2014.

(30) Foreign Application Priority Data

Jun. 21, 2013 (JP) ..... 2013-131195

(51) Int. Cl.

| | |
|---|---|
| ***H01Q 9/16*** | (2006.01) |
| ***H01Q 1/50*** | (2006.01) |
| ***H01Q 9/28*** | (2006.01) |
| *H01Q 9/06* | (2006.01) |

(52) U.S. Cl.

CPC ..... *H01Q 1/50* (2013.01); *H01Q 9/16* (2013.01); *H01Q 9/285* (2013.01); *H01Q 9/065* (2013.01)

(58) Field of Classification Search

USPC ..... 343/820, 795, 895, 700 MS

See application file for complete search history.

(56) References Cited

U.S. PATENT DOCUMENTS 7,446,714 B2 * 11/2008 Biddulph ..... 343/700 MS
7,633,455 B2 12/2009 Yamagajo et al.

(Continued)

FOREIGN PATENT DOCUMENTS

JP 2007-221344 8/2007
JP 2007-266999 10/2007

(Continued)

OTHER PUBLICATIONS

International Search Report dated Sep. 22, 2014 in PCT/JP2014/066334, filed Jun. 19, 2014 (with English Translation).

(Continued)

*Primary Examiner* — Jessica Han
*Assistant Examiner* — Hai Tran
(74) *Attorney, Agent, or Firm* — Oblon, McClelland, Maier & Neustadt, L.L.P.

(57) ABSTRACT

An antenna includes a feeding element connected to a feeding point, a first radiating element that is spaced apart from the feeding element and is coupled to the feeding element through electromagnetic field coupling, a second radiating element that is spaced apart from the feeding element and is coupled to the feeding element through electromagnetic field coupling, a first control element that is connected to the feeding element via a first impedance variable unit, and a second control element that is connected to the feeding element via a second impedance variable unit, and a control unit that controls the first impedance variable unit to adjust the connection between the feeding element and the first control element and controls the second impedance variable unit to adjust the connection between the feeding element and the second control element.

20 Claims, 24 Drawing Sheets

(56) References Cited

U.S. PATENT DOCUMENTS

| | | | | |
|---|---|---|---|---|
| 7,667,651 | B2 * | 2/2010 | McKivergan | H01Q 7/00 343/700 MS |
| 7,675,469 | B2 | 3/2010 | Ohba et al. | |
| 2005/0052334 | A1 | 3/2005 | Ogino et al. | |
| 2005/0119035 | A1 | 6/2005 | Miyano et al. | |
| 2007/0046542 | A1 | 3/2007 | Andrenko et al. | |
| 2007/0052599 | A1 | 3/2007 | Shimizu et al. | |
| 2007/0229384 | A1 | 10/2007 | Yamagajo et al. | |
| 2008/0266190 | A1 | 10/2008 | Ohba et al. | |
| 2009/0295667 | A1 * | 12/2009 | Ma | H01Q 1/2225 343/795 |
| 2011/0109262 | A1 * | 5/2011 | Iizuka | B60L 11/182 320/108 |
| 2013/0271339 | A1 | 10/2013 | Mikata | |

FOREIGN PATENT DOCUMENTS

| | | |
|---|---|---|
| JP | 2008-278219 | 11/2008 |
| JP | 4422767 | 2/2010 |
| JP | 2012-186562 | 9/2012 |
| WO | WO 2007/043150 A1 | 4/2007 |

OTHER PUBLICATIONS

Written Opinion dated Sep. 22, 2014 in PCT/JP2014/066334, filed Jun. 19, 2014.

Andre Kurs et al. "Wireless Power Transfer via Strongly Coupled Magnetic Resonances", Science, vol. 317, Jul. 6, 2007, 4 pages.

* cited by examiner

ANTENNA, ANTENNA DEVICE, AND WIRELESS DEVICE

CROSS-REFERENCE TO RELATED APPLICATION

The present application is a continuation application filed under 35 U.S.C. 111(a) claiming benefit under 35 U.S.C. 120 and 365(c) of PCT International Application No. PCT/JP2014/066334 filed on Jun. 19, 2014 and designating the U.S., which claims priority to Japanese Patent Application No. 2013-131195 filed on Jun. 21, 2013. The entire contents of the foregoing applications are incorporated herein by reference.

BACKGROUND OF THE INVENTION

1. Field of the Invention

The present invention generally relates to an antenna, an antenna device, and a wireless device such as a mobile phone.

2. Description of the Related Art

Techniques are known for controlling the directivity of an antenna by switching a connection destination of a feeding point. For example, Japanese Laid-Open Patent Publication No. 2012-186562 (Patent Document 1) discloses an antenna including a switch for switching the directivity of a radiating conductor by controlling a feeding point to come into contact with either one of two end points of the radiating conductor.

On the other hand, Japanese Patent No. 4422767 (Patent Document 2) discloses an antenna that is operable in multiple frequency bands by having a feeding element and a parasitic element that are coupled without being in contact.

However, it has been difficult to control the directivity of an antenna that has a contactless feeding system as disclosed in Patent Document 2 where a feeding element connected to a feeding point is coupled to a radiating element (parasitic element) without being in contact. For example, the switching technique disclosed in Patent Document 1 that involves controlling the directivity of an antenna by switching the connection point of a feeding element to a radiating element cannot be implemented in the antenna disclosed in Patent Document 2 because the feeding element and the radiating element have to be coupled without being in contact. Also, various constrains may be imposed on the arrangement and shape of the feeding element in order to prevent coupling at unintended locations when a connection point is switched, for example.

In view of the above, there is a demand for a technique for controlling the directivity of an antenna having a feeding element and a radiating element that are coupled without being in contact.

SUMMARY OF THE INVENTION

An aspect of the present invention relates to implementing a technique for controlling the directivity of an antenna, an antenna device, and a wireless device having a feeding element and a radiating element that are coupled without being in contact.

According to one aspect of the present invention, an antenna, an antenna device, and a wireless device are provided that include a feeding element that is connected to a feeding point; a first radiating element that is spaced apart from the feeding element and is fed by being coupled to the feeding element through electromagnetic field coupling to function as a radiating conductor; a second radiating element that is spaced apart from the feeding element and is fed by being coupled to the feeding element through electromagnetic field coupling to function as a radiating conductor; a first control element that is connected to the feeding element via a first impedance variable unit and is arranged such that when an impedance of the first impedance variable unit at a resonant frequency of the first radiating element is decreased, the electromagnetic field coupling between the feeding element and the first radiating element is weakened and the function of the first radiating element as the radiating conductor is degraded; a second control element that is connected to the feeding element via a second impedance variable unit and is arranged such that when an impedance of the second impedance variable unit at a resonant frequency of the second radiating element is decreased, the electromagnetic field coupling between the feeding element and the second radiating element is weakened and the function of the second radiating element as the radiating conductor is degraded; and a control unit that controls the first impedance variable unit to adjust the connection between the feeding element and the first control element, and controls the second impedance variable unit to adjust the connection between the feeding element and the second control element.

According to another aspect of the present invention, an antenna, an antenna device, and a wireless device are provided that include a feeding element that is connected to a feeding point; a first radiating element that is spaced apart from the feeding element and is fed by being coupled to the feeding element through electromagnetic field coupling to function as a radiating element; a second radiating element that is spaced apart from the feeding element and is fed by being coupled to the feeding element through electromagnetic field coupling to function as a radiating element; a first control element that is connected to the feeding element via a first impedance variable unit; a second control element that is connected to the feeding element via a second impedance variable unit; and a control unit that controls the first impedance variable unit to adjust the connection between the feeding element and the first control element, and controls the second impedance variable unit to adjust the connection between the feeding element and the second control element. The first control element is arranged such that a high impedance portion of the first control element having a high impedance at a resonant frequency of the first radiating element and a low impedance portion of the first radiating element having a low impedance at the resonant frequency of the first radiating element are positioned close to each other, and the second control element is arranged such that a high impedance portion of the second control element having a high impedance at a resonant frequency of the second radiating element and a low impedance portion of the second radiating element having a low impedance at the resonant frequency of the second radiating element are positioned close to each other.

DESCRIPTION OF THE PREFERRED EMBODIMENTS

In the following, embodiments of the present invention will be described with reference to the accompanying drawings.

<Antenna 1>

Figure 1:
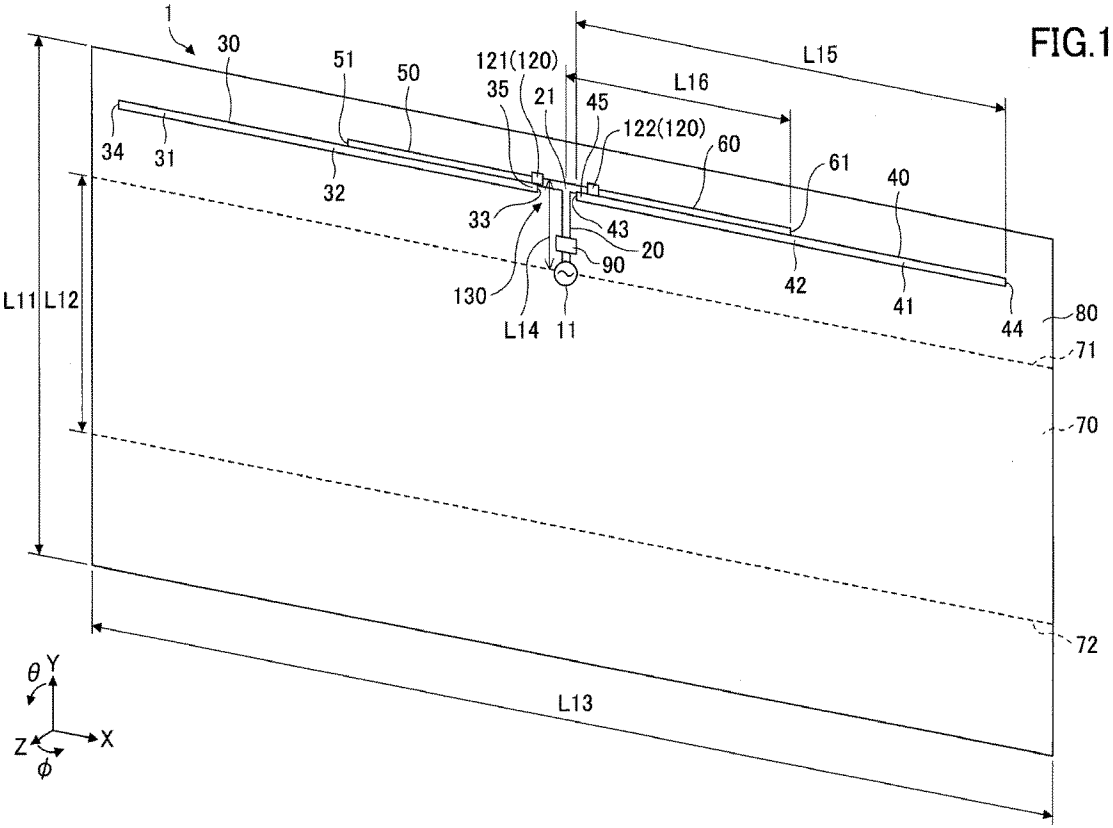
FIG. 1 is a perspective view of an exemplary analysis model of an antenna according to a first embodiment of the present invention.

FIG. 1 is a perspective view of an exemplary computer simulation model for analyzing the operation of an antenna 1 according to a first embodiment of the present invention. Note that in the present example, CST Microwave Studio (registered trademark) by Computer Simulation Technology AG (CST) was used as an electromagnetic field simulator.

The antenna 1 includes a feeding point 11, a ground plane 70, a feeding element 20, a first radiating element 30, a second radiating element 40, a first feeding portion 35, a second feeding portion 45, a first control element 50, a second control element 60, and an impedance control unit 120. Note that in the following descriptions, the first radiating element 30, the second radiating element 40, the first feeding portion 35, the second feeding portion 45, the first control element 50, and the second control element 60 may simply be referred to as "radiating element 30," "radiating element 40," "feeding portion 35," "feeding portion 45," "control element 50," and "control element 60," respectively. Note that the feeding portion 35 is a feeding portion for feeding the radiating element 30, and the feeding portion 45 is a feeding portion for feeding the radiating element 40. That is, the feeding portions 35 and 45 do not constitute feeding portions for the antenna 1. The feeding point 11 constitutes the feeding portion for feeding the antenna 1.

The feeding point 11 is a feeding portion that is connected to a predetermined transmission line or a feeding line that uses the ground plane 70. Specific examples of a predetermined transmission line includes a microstrip line, a strip line, a coplanar waveguide with a ground plane (coplanar waveguide having a ground plane arranged on a surface opposing a conductor surface), and the like. Specific examples of a feeding line include a feeder line, a coaxial cable, and the like. The feeding point 11 may be arranged at a central portion of an outer edge 71 of the ground plane 70.

The feeding element 20 is a conductor that is connected to the feeding point 11 that uses the ground plane 70 as a ground reference. The feeding element 20 may be connected to a feeding circuit that is mounted on a substrate 80 (e.g., an integrated circuit such as an IC chip, which is not shown) via the feeding point 11, for example. The feeding element 20 and the feeding circuit may be interconnected via one or more of the various types of transmission lines and feeding lines described above.

The feeding element 20 is a conductor that is arranged a predetermined distance apart from the radiating element 30 and the radiating element 40. For example, the feeding element 20 may be spaced apart from the radiating element 30 and the radiating element 40 by a gap having a parallel direction component in the Z-axis.

In the example illustrated in FIG. 1, the feeding element 20 overlaps with the radiating element 30 and the radiating element 40 in plan view from a direction parallel to the Z-axis. Note, however, that the feeding element 20 does not necessarily have to overlap with the radiating element 30 and the radiating element 40 in plan view from the direction parallel to the Z-axis as long as the feeding element 20 is adequately spaced apart from the radiating element 30 and the radiating element 40 to be capable of performing non-contact feeding of the radiating element 30 and the radiating element 40. For example, the feeding element 20, the radiating element 30, and the radiating element 40 may overlap in plan view from any direction including a direction parallel to the X-axis or the Y-axis.

The feeding element 20 is capable of feeding the radiating element 30 via the feeding portion 35 of the radiating element 30 without being in contact with the radiating element 30. Also, the feeding element 20 is capable of feeding the radiating element 40 via the feeding portion 45 of the radiating element 40 without being in contact with the radiating element 40. For example, the feeding element 20 may be a linear conductor having at least a portion of the feeding element 20 and the ground plane 70 arranged to not overlap in plan view from a direction normal to the ground plane 70. Note that a direction normal to the ground plane 70 corresponds to a direction parallel to the Z-axis in FIG. 1.

The feeding element 20 may be a linear conductor having a linear conductor portion extending from the feeding point 11, as a starting point, to an end portion 21, in a direction away from the outer edge 71 of the ground plane 70, which is parallel to the XY plane. The end portion 21 is a portion located at the tip of the feeding element 20 in the direction away from the outer edge 71. In FIG. 1, the feeding element 20 extends in a direction parallel to the ground plane 70 and perpendicular to the outer edge 71. Note that a direction parallel to the ground plane 70 and perpendicular to the outer edge 71 corresponds to a direction parallel to the Y-axis in FIG. 1.

Note that although FIG. 1 illustrates an exemplary case where a matching circuit 90 is arranged at the feeding element 20, the matching circuit 90 may be omitted in other examples. Note that the matching circuit 90 will be described in greater detail below.

The feeding element 20 extends from the feeding point 11 to the end portion 21 in a direction toward a gap 130 formed between one end portion 33 of the radiating element 30 and one end portion 43 of the radiating element 40 in plan view from a direction normal to the ground plane 70. The feeding element 20 includes the end portion 21, which is spaced apart by a predetermined distance from the end portion 33 of the radiating element 30 and the end portion 43 of the radiating element 40, and the end portion 21 is positioned in the vicinity of the gap 130.

Note that although FIG. 1 illustrates an exemplary case where the feeding element 20 corresponds to a T-shaped conductor element arranged within an XY plane, the feeding element 20 may be in other shapes such as an L-shape or an I-shape, for example. Also, the feeding element 20 may include a conductor portion extending in the XY plane and a conductor portion extending in a plane other than the XY plane, for example.

The radiating element 30 is a radiating conductor that includes the end portion 33 and another end portion 34, and extends linearly from the end portion 33 to the other end portion 34. Note that the end portion 33 and the end portion 34 are open ends that are not connected to another conductor. For example, the radiating element 30 may be a linear conductor having at least a portion of the radiating element 30 and the ground plane 70 arranged to not overlap in plan view from a direction normal to the ground plane 70.

For example, the radiating element 30 may be a linear conductor having a linear radiating conductor portion arranged along the outer edge 71 of the ground plane 70. The radiating element 30 may include a conductor portion 31 that is spaced apart from the outer edge 71 by a predetermined shortest distance and extends in a direction parallel to the outer edge 71 facing the outer edge 71 of the ground plane 70, for example. Note that a direction parallel to the outer edge 71 corresponds to a direction parallel to the X-axis in FIG. 1. By having the radiating element 30 include the conductive portion 31 extending along the outer edge 71, the directivity of the antenna 1 may be easily controlled, for example.

Note that although FIG. 1 illustrates an exemplary case where the radiating element 30 corresponds to a linear radiating element arranged in the XY plane, the radiating element 30 may be in other shapes such as an L-shape, for example (see FIG. 28 and descriptions below). Also, the radiating element 30 may include a conductor portion extending in the XY plane and a conductor portion extending in a plane other than the XY plane, for example.

The radiating element 40 may have a configuration identical or similar to the configuration of the radiating element 30 as described above. As such, detailed descriptions thereof are omitted. The radiating element 40 is an antenna conductor that includes one end portion 43 and another end portion 44, and extends linearly from the end portion 43 to the other end portion 44. The radiating element 40 may include a conductor portion 41 that is spaced apart from the outer edge 71 by a predetermined shortest distance and extends in a direction parallel to the outer edge 71 facing the outer edge 71 of the ground plane 70, for example.

The radiating element 30 and the radiating element 40 are conductors that extend in different directions from each other. That is, the radiating element 30 and the radiating element 40 extend in directions away from each other from the feeding element 20. Note that although FIG. 1 illustrates an example where the radiating element 30 and the radiating element 40 correspond to conductors arranged on the same XY plane, the radiating element 30 and the radiating element 40 may alternatively be arranged in different planes, for example. Also, although FIG. 1 illustrates an example where the radiating element 30 and the radiating element 40 are arranged along a single straight line, the radiating element 30 and the radiating element 40 may alternatively be arranged along different straight lines. For example, in plan view from a direction parallel to the Z-axis in FIG. 1, one of the radiating element 30 and the radiating element 40 may be arranged closer to the ground plane 70 and the other may be arranged farther away from the ground plane 70 with respect to the end portion 21 of the feeding element 20.

The control element 50 is a conductor that is spaced apart by a predetermined distance from the radiating element 30. For example, the control element 50 may be spaced apart from the radiating elements 30 by a gap having a parallel direction component in the Z-axis. The control element 50 is connected to the end portion 21 of the feeding element 20 via an impedance control unit 120 and extends linearly from the impedance control unit 120 to an end portion 51. The end portion 51 is an open end that is not connected to another conductor. For example, the control element 50 may be a linear conductor having at least a portion of the control element 50 and the ground plane 70 arranged so as not to overlap in plan view from a direction normal to the ground plane 70.

For example, the control element 50 may be a linear conductor having a linear conductor portion arranged along the radiating element 30. Note that although FIG. 1 illustrates an example where the control element 50 is a linear element arranged in the XY plane, the control element 50 may be in other shapes such as an L-shape (see FIG. 28 and descriptions below). Also, the control element 50 may include a conductor portion extending in the XY plane and a conductor portion extending in a plane other than the XY plane, for example.

The control element 60 is a conductor that is spaced apart by a predetermined distance from the radiating element 40. The control element 60 may have a configuration identical or similar to the configuration of the control element 50 as described above. As such, detailed descriptions thereof are omitted. The control element 60 is connected to the end portion 21 of the feeding element 20 via the impedance control unit 120 and extends linearly from the impedance control unit 120 to an end portion 61.

Note that although FIG. 1 illustrates an example where the control element 50 and the control element 60 correspond to conductors arranged within the same XY plane, the control element 50 and the control element 60 may alternatively be arranged in different planes, for example. Also, although FIG. 1 illustrates an example where the control element 50 and the control element 60 are arranged along a single straight line, the control element 50 and the control element 60 may alternatively be arranged along different straight lines, for example. Also, although FIG. 1 illustrates an example where the control element 50 and the control element 60 are arranged on the same XY plane together with the feeding element 20, the control element 50 and the control element 60 may alternatively be arranged in a plane different from that on which the feeding element 20 is arranged.

Figure 2:
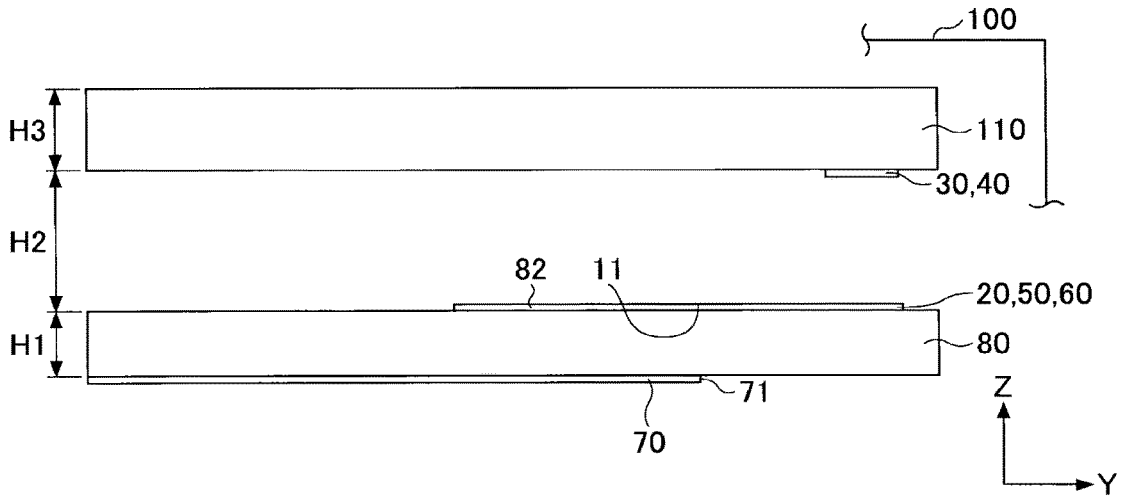
FIG. 2 is a diagram schematically illustrating an exemplary positional relationship between components of the antenna according to the first embodiment.

FIG. 2 schematically illustrates a positional relationship between the components of the antenna 1 with respect to the Z-axis direction. An antenna according to an embodiment of the present invention may be installed in a wireless device (e.g., portable communication terminal). Specific examples of the wireless device include various types of electronic devices such as information terminals, mobile phones, smart phones, personal computers, game consoles, TVs, music/video players, etc.

For example, in FIG. 2, in a case where the antenna 1 is installed in a wireless communication device 100 including a display (as one example of the wireless device), a cover glass covering the entire image display surface of the display may be provided as a substrate 110, for example, or the substrate 110 may be a housing (top cover, back cover, side wall, etc.) to which the substrate 80 is fixed, for example. The cover glass may be a flat member arranged on top of the display and may be a transparent or semi-transparent dielectric substrate that allows a user to view an image displayed by the display.

In a case where the radiating elements 30 and 40 are arranged on the surface of the cover glass, the radiating elements 30 and 40 may be formed by applying a conductive paste such as copper or silver on the surface of the cover glass and performing a firing process thereon, for example. Note that the conductive paste used in this case is preferably a type that can be fired at a sufficiently low temperature so as to not affect the reinforced properties of the chemically reinforced glass used for the cover glass. Also, a plating process may be performed in order to prevent deterioration of the conductors due to oxidation, for example. Also, a decorative printing process may be performed on the cover glass and the conductors may be formed on the decorative printed portions. Also, in a case where a black concealing layer is arranged at the peripheral edge of the cover glass for the purpose of concealing wiring and the like, the radiating elements 30 and 40 may be formed on the black concealing layer, for example.

Also, the positions of the feeding element 20, the radiating elements 30 and 40, the control elements 50 and 60, and the ground plane 70 with respect to a height direction parallel to the Z-axis may be different from one another, partially the same, or all the same.

Also, in some examples, one feeding element may be configured to feed a plurality of radiating elements. By utilizing a plurality of radiating elements, multi-band operation, wide-band operation, and/or directivity control may be facilitated, for example. Also, in some examples, a plurality of antennas may be installed in one wireless communication device.

Note that although FIG. 2 illustrates an example where the feeding element 20 and the control elements 50 and 60 are arranged on the surface of the substrate 80, these elements may alternatively be arranged within the substrate 80, for example.

In one example, a chip component including the feeding element 20 and a medium in contact with the feeding element 20 may be mounted to the substrate 80. In this way, the feeding element 20 that is in contact with the medium may be easily mounted to the substrate 80.

The substrate 80 may be made from a dielectric material, a magnetic material, or a combination of dielectric and magnetic materials. Specific examples of dielectric materials include resin, glass, glass ceramics, LTCC (Low Temperature Co-Fired Ceramics), alumina, and the like. Specific examples of a combination of dielectric and magnetic materials include hexagonal crystal system ferrites, spinel ferrites (Mn—Zn ferrites, Ni—Zn ferrites, etc.), garnet ferrites, permalloy, Sendust (registered trademark), and other materials including a transition metal element such as Fe, Ni, or Co, and a metal or an oxide including a rare earth element such as Sm or Nd, for example.

The substrate 80 includes the ground plane 70, and the feeding point 11 that uses the ground plane 70 as a ground reference. Note that although FIG. 2 illustrates an example where the ground plane 70 is formed on a surface layer of the substrate 80, the ground plane 70 may alternatively be formed on an inner layer of the substrate 80, for example.

The substrate 80 includes a transmission line having a strip conductor 82 that is connected to the feeding point 11. The strip conductor 82 may be a signal line formed on the surface of the substrate 80 such that the substrate 80 may be interposed between the strip conductor 82 and the ground plane 70, for example.

The radiating elements 30 and 40 are positioned apart from the feeding element 20 and the control elements 50 and 60. For example, as illustrated in FIG. 2, the radiating elements 30 and 40 may be arranged on the substrate 110 that faces the substrate 80 and is spaced apart from the substrate 80 by a distance H2. The substrate 110 may be made from a dielectric material, a magnetic material, or a combination of dielectric and magnetic materials. Specific examples of the material of the substrate 110 may be the same as those of the substrate 80 as described above. Note that in FIG. 2, the radiating elements 30 and 40 are arranged on a surface of the substrate 110 facing the feeding element 20 and the control elements 50 and 60. However, the radiating elements 30 and 40 may alternatively be arranged on the surface of the substrate 110 on the opposite side of the surface facing the feeding element 20 and the control elements 50 and 60. The radiating elements 30 and 40 may also be arranged at a side face of the substrate 110, for example.

The feeding element 20 and the radiating elements 30 and 40 may be spaced apart from each other by a distance that enables electromagnetic field coupling between the feeding element 20 and the radiating elements 30 and 40, for example. By coupling the feeding element 20 and the radiating element 30 through electromagnetic field coupling, noncontact feeding of the radiating element 30 at the feeding portion 35 via the feeding element 20 may be realized. By feeding the radiating element 30 in this manner, the radiating element 30 may function as a radiating conductor of the antenna 1. In the case where the radiating element 30 is a linear conductor connecting two points as illustrated in FIG. 1, a resonance current (standing wave current distribution) similar to that formed on a half wave dipole antenna may be formed on the radiating element 30. That is, the radiating element 30 may function as a dipole antenna that resonates at half the wavelength of a predetermined frequency (hereinafter referred to as "dipole mode"). In another example, the radiating element may be a looped conductor. In a case where the radiating element is a looped conductor, a resonant current (standing wave current distribution) similar to that formed on a loop antenna may be formed on the radiating element. That is, the radiating element may function as a loop antenna that resonates at one wavelength of a predetermined frequency (hereinafter referred to as "loop mode"). Note that electromagnetic field coupling may be similarly established between the radiating element 40 and the feeding element 20 to enable noncontact feeding of the radiating element 40 at the feeding portion 45 via the feeding element 20. However, detailed descriptions thereof are omitted because they may be substantially the same as the above descriptions relating to the radiating element 30.

Electromagnetic field coupling refers to coupling that utilizes a resonance phenomenon of an electromagnetic field as disclosed, for example, in the following non-patent literature: A. Kurs et. al., "Wireless Power Transfer via Strongly Coupled Magnetic Resonances," Science Express, Vol. 317, No. 5834, pp. 83-86, July 2007. Electromagnetic field coupling, also referred to as "electromagnetic field resonance coupling" or "electromagnetic field resonant coupling," is a technique in which resonators that resonate at the same frequency are brought close to each other, one of the resonators is caused to resonate to generate a near field (non-radiation field area) between the resonators, and energy is transmitted to another one of the resonators via coupling at the near field. Also, electromagnetic field coupling refers to coupling via an electric field and a magnetic field at a high frequency excluding electrostatic capacitive coupling and electromagnetic induction coupling. Here, "excluding electrostatic capacitive coupling and electromagnetic induction coupling" does not necessarily mean electrostatic capacitive coupling and electromagnetic induction coupling are completely eliminated, but indicates that their influence is negligible. A medium between the feeding element 20 and the radiating elements 30 and 40 may be air or a dielectric material such as glass or resin. It is preferable to not place a conductor material such as a ground plane or a display between the feeding element 20 and the radiating elements 30 and 40.

By coupling the feeding element 20 and the radiating elements 30 and 40 through electromagnetic field coupling, a durable structure that is resistant to impact may be obtained. That is, by utilizing electromagnetic field coupling, feeding of the radiating elements 30 and 40 may be implemented using the feeding element 20 without requiring physical contact between the feeding element 20 and the radiating elements 30 and 40, and thus, a durable structure that is resistant to impact may be obtained as compared to a contact type feeding mechanism that requires physical contact between the feeding element and the radiating element.

Also, as compared with feeding using electrostatic capacitive coupling, when feeding using electromagnetic field coupling is implemented, the total efficiency (antenna gain) of the radiating elements 30 and 40 may be less likely to decrease even if the distance between the feeding element 20 and the radiating elements 30 and 40 (coupling distance) is increased. Note that the total efficiency is calculated based on the radiation efficiency×return loss of the antenna, and the total efficiency is defined as the efficiency of the antenna with respect to the input power. Therefore, by coupling the feeding element 20 and the radiating elements 30 and 40 through electromagnetic field coupling, a greater degree of freedom for determining the arrangement positions of the feeding element 20 and the radiating elements 30 and 40 may be obtained and position robustness may be increased. Note that when high position robustness is achieved, this means that the total efficiency of the radiating elements 30 and 40 may be less likely to be affected even when variations occur in the arrangement positions of the feeding element 20 and the radiating elements 30 and 40. Also, by obtaining a greater degree of freedom for determining the arrangement positions of the feeding element 20 and the radiating elements 30 and 40, the space required for installing the antenna 1 may be easily reduced. Also, by feeding the radiating elements 30 and 40 through electromagnetic field coupling as opposed to feeding through electrostatic capacitive coupling, for example, feeding of the radiating elements 30 and 40 may be performed via the feeding element 20 without the use of other components such as a capacitance plate, and as such, feeding may be realized through a simple structure.

Also, in FIG. 1, the feeding portion 35, which corresponds to a part of the radiating element 30 that is fed by the feeding element 20, is positioned at a region between the end portion 33 and the other end portion 34 of the radiating element 30 other than a central portion 32 (region between the central portion 32 and the end portion 33 or the end portion 34). By positioning the feeding portion 35 at a region of the radiating element 30 other than the region having the lowest impedance at the resonant frequency of the fundamental mode of the radiating element 30 (the central portion 32 in the present case), impedance matching of the antenna 1 may be facilitated. The feeding portion 35 is defined by a region at a conductor portion of the radiating element 30 (conductor portion of the radiating element 30 that is closest to the feeding element 20) that is closest to the feeding point 11.

The impedance of the radiating element 30, when in dipole mode, becomes higher as the distance from the central portion 32 toward the end portion 33 or the end portion 34 of radiating element 30 increases. In the case of coupling at high impedance by electromagnetic field coupling, even when slight variations occur in the impedance between the feeding element 20 and the radiating element 30, its impact on impedance matching may be relatively small as long as the feeding element 20 and the radiating element 30 are coupled at a sufficiently high impedance of at least a certain level. Thus, to facilitate matching, the feeding portion 35 of the radiating element 30 is preferably positioned at a high impedance portion of the radiating element 30.

For example, to facilitate impedance matching of the antenna 1, the feeding portion 35 may be positioned at a region spaced apart from the region having the lowest impedance at the resonant frequency of the fundamental mode of the radiating element 30 (the central portion 32 in the present case) by a distance greater than or equal to ⅛ of the total length of the radiating element 30 (preferably greater than or equal to ⅙ of the total length, and more preferably greater than or equal to ¼ of the total length). In FIG. 1, the total length of the radiating element 30 is the same as a total length L15 of the radiating element 40, and the feeding portion 35 is positioned away from the central portion 32 toward the end portion 33.

The feeding portion 45 corresponds to a part of the radiating element 40 at which feeding of the radiating element 40 is implemented. Note that because features of the feeding portion 45 may be substantially identical to those of the feeding portion 35, detailed descriptions thereof will be omitted. Note that in the case where the fundamental mode of resonance of the radiating elements corresponds to the loop mode, the feeding portion may be positioned at a region spaced apart from the region having the highest impedance at the resonant frequency of the fundamental mode of the radiating element by a distance less than or equal to 3/16 of the inner circumference of the loop (preferably less than or equal to ⅛ of the inner circumference, and more preferably less than or equal to 1/16 of the inner circumference).

Also, assuming Le20 denotes the electrical length that imparts the fundamental mode of resonance to the feeding element 20, Le30 and Le40 respectively denote the electrical lengths that impart the fundamental mode of resonance to the radiating elements 30 and 40, and λ denotes a wavelength on the feeding element 20 or the radiating element 30 or 40 at a resonant frequency $f_1$ of the fundamental mode of the radiating elements 30 and 40, Le20 is preferably less than or equal to (3/8)λ, Le30 and Le40 are preferably greater than or equal to (3/8)λ and less than or equal to (5/8)λ in the case where the fundamental mode of resonance of the radiating elements 30 and 40 corresponds to the dipole mode, and Le30 and Le40 are preferably greater than or equal to (7/8)λ and less than or equal to (9/8)λ in the case where the fundamental mode of resonance of the radiating elements 30 and 40 corresponds to the loop mode.

The electrical length Le20 is preferably less than or equal to (3/8)λ. Also, in order to allow a greater degree of freedom in the configuration including the presence/absence of the ground plane 70, the electrical length Le20 may preferably be greater than or equal to (1/8)λ and less than or equal to (3/8)λ, and more preferably greater than or equal to (3/16)λ and less than or equal to (5/16)λ. By arranging the electrical length Le20 to be within the above ranges, resonance of the feeding element 20 may occur at the design frequency (resonant frequency $f_1$) of the radiating elements 30 and 40, and in this way, the feeding element 20 and the radiating elements 30 and 40 may resonate without depending on the ground plane 70 of the antenna 1 and desirable electromagnetic field coupling may be achieved.

Also, when the ground plane 70 is formed such that the outer edge 71 extends along the radiating elements 30 and 40, a resonance current (standing wave current distribution) may be formed on the feeding element 20 and the ground plane 70 as a result of an interaction between the feeding element 20 and the outer edge 71, and the feeding element 20 may resonate and be coupled with the radiating elements 30 and 40 through electromagnetic field coupling. For this reason, there is no specific lower limit for the electrical length Le20 of the feeding element 20 as long as the feeding element 20 has a physical length that is sufficient to be coupled to the radiating elements 30 and 40 by electromagnetic field coupling.

Note that when electromagnetic field coupling is achieved this means that impedance matching is achieved. Also, in this case, the electrical length Le20 of the feeding element 20 does not have to be designed to a suitable electrical length according to the resonant frequency of the radiating elements 30 and 40, and the feeding element 20 may be freely designed as a radiating conductor. In this way, the antenna 1 may be easily designed to support multiple frequencies. Note that the sum of the length of the outer edge 71 of the ground plane 70 extending along the radiating elements 30 and 40 and the electrical length of the feeding element 20 is preferably greater than or equal to (¼)λ of the design frequency (resonant frequency $f_1$).

When the feeding element 20 does not include a component such as a matching circuit, a physical length L20 of the feeding element 20 (L14 in the case of FIG. 1) is determined by $\lambda_{g1}=\Delta_0 k_1$, where $\lambda_0$ denotes the radio wave wavelength in vacuum at the resonant frequency of the fundamental mode of the radiating elements 30 and 40, and $k_1$ denotes a shortening coefficient of a wavelength shortening effect in an actual environment. Here, $k_1$ is calculated based on, for example, a relative permittivity and a relative permeability of a medium (environment) such as an effective relative permittivity ($\in_{r1}$) and an effective relative permeability ($\mu_{r1}$) of the dielectric substrate at which the feeding element is arranged, a thickness of the medium (environment), and a resonant frequency. That is, L20 is less than or equal to $(3/8)\lambda_{g1}$. The physical length L20 of the feeding element 20 is a physical length that gives Le20. In an ideal case where no other factor is considered, the physical length L20 is equal to Le20. When the feeding element 20 includes a matching circuit, for example, L20 is preferably greater than zero and less than or equal to Le20. By using a matching circuit such as an inductor, L20 can be reduced (i.e., the size of the feeding element 20 can be reduced).

In the case where the fundamental mode of resonance of the radiating elements 30 and 40 corresponds to the dipole mode (i.e., when the radiating elements 30 and 40 are linear conductors having open ends), Le30 and Le 40 are preferably greater than or equal to (3/8)λ and less than or equal to (5/8)λ, more preferably greater than or equal to (7/16)λ and less than or equal to (9/16)λ, and more preferably greater than or equal to (15/32)λ and less than or equal to (17/32)λ. When a higher-order mode is taken into account, Le30 and Le40 are preferably greater than or equal to (3/8)λm and less than or equal to (5/8)λm, more preferably greater than or equal to (7/16)λm and less than or equal to (9/16)λm, and more preferably greater than or equal to (15/32)λm and less than or equal to (17/32)λm. Here, m denotes a mode number of a higher-order mode and is represented by a natural number. The value of m is preferably an integer between 1 through 5, and more preferably an integer between 1 through 3. In this case, m=1 represents the fundamental mode. When Le30 and Le40 are within the above ranges, the radiating elements 30 and 40 may function sufficiently as radiating conductors, and the efficiency of the antenna 1 may be desirably high.

Also, in the case where the fundamental mode of resonance of the radiating elements 30 and 40 corresponds to the loop mode (i.e., when the radiating elements 30 and 40 are looped conductors), Le30 and Le 40 are preferably greater than or equal to (7/8)λ and less than or equal to (9/8)λ, more preferably greater than or equal to (15/16)λ and less than or equal to (17/16)λ, and more preferably greater than or equal to (31/32)λ and less than or equal to (33/32)λ. When a higher-order mode is taken into account, Le30 and Le40 are preferably greater than or equal to (7/8)λm and less than or equal to (9/8)λm, more preferably greater than or equal to (15/16)λm and less than or equal to (17/16)λm, and more preferably greater than or equal to (31/32)λm and less than or equal to (33/32)λm.

Note that physical lengths L30 and L40 of the radiating elements 30 and 40 (corresponding to length L15 in the case of FIG. 1) are determined by $\lambda_{g2}=\lambda_0 k_2$, where $\lambda_0$ denotes the radio wave wavelength in vacuum at the resonant frequency of the fundamental mode of the radiating elements 30 and 40, and $k_2$ denotes a shortening coefficient of a wavelength shortening effect in an actual environment. Here, $k_2$ is calculated based on, for example, a relative permittivity and a relative permeability such as an effective relative permittivity ($\in_{r2}$) and an effective relative permeability ($\mu_{r2}$) of a medium (environment) such as a dielectric substrate at which the radiating elements 30 and 40 are arranged, a thickness of the medium (environment), and a resonant frequency. That is, in the case where the fundamental mode of resonance of the radiating elements 30 and 40 is the dipole mode, L30 and L40 are greater than or equal to $(3/8)\lambda_{g2}$ and less than or equal to $(5/8)\lambda_{g2}$, and in the case where the fundamental mode of resonance of the radiating elements 30 and 40 corresponds to the loop mode, L30 and L40 are greater than or equal to $(7/8)\lambda_{g2}$ and less than or equal to $(9/8)\lambda_{g2}$. The physical lengths L30 and L40 of the radiating elements 30 and 40 are physical lengths that give Le30 and Le40. In an ideal case where no other factors are considered, the physical lengths L30 and L40 are equal to Le30 and Le40. Even when L30 and L40 are shortened by using a matching circuit such as an inductor, for example, L30 and L40 are preferably within a range greater than zero and less than or equal to Le30 and Le40, and more preferably greater than or equal to 0.4×Le30 and 0.4×Le40 and less than or equal to Le30 and Le40.

Also, in the case where the interaction between the feeding element 20 and the outer edge 71 of the ground plane 70 is utilized as illustrated in FIG. 1, the feeding element 20 may function as a radiating conductor as described above. By having the feeding element 20 implement noncontact feeding of the radiating elements 30 and 40 at their feeding portions 35 and 45 through electromagnetic field coupling, the radiating elements 30 and 40 may be radiating conductors that function as λ/2 dipole antennas, for example. Note that while the feeding element 20 is a linear conductor that is capable of feeding the radiating elements 30 and 40, the feeding element 20 may also be capable of functioning as a monopole antenna (e.g., λ/4 monopole antenna) that is fed at the feeding point 11, for example. By setting the resonant frequency of the radiating elements 30 and 40 to $f_1$, setting the resonant frequency of the feeding element 20 to $f_2$, and adjusting the length of the feeding element 20 to realize a monopole antenna that resonates at the frequency $f_2$, the radiating function of the feeding element 20 may be utilized and the antenna 1 may be configured to support multiple frequencies with relative ease.

The physical length L20 of the feeding element 20 when utilizing the radiating function of the feeding element 20, assuming the feeding element 20 does not include a component such as a matching circuit, is determined by $\lambda_{g3}=\lambda_1 k_1$, where $\lambda_1$ denotes the radio wave wavelength in vacuum at the resonant frequency $f_2$ of the feeding element 20, and $k_1$ denotes a shortening coefficient of a wavelength shortening effect in an actual environment. Here, $k_1$ is calculated based on, for example, a relative permittivity and a relative permeability such as an effective relative permittivity ($\in_{r1}$) and an effective relative permeability ($\mu_{r1}$) of a medium (environment) such as a dielectric substrate at which the feeding element 20 is arranged, a thickness of the medium (environment), and the resonant frequency. That is, L20 is greater than or equal to $(1/8)\lambda_{g3}$ and less than or equal to $(3/8)\lambda_{g3}$, and preferably greater than or equal to $(3/16)\lambda_{g3}$ and less than or equal to $(5/16)\lambda_{g3}$. The physical length L20 of the feeding element 20 is a physical length that gives Le20. In an ideal case where no other factor is considered, the physical length L20 is equal to Le20. When the feeding element 20 includes a matching circuit, for example, L20 is preferably greater than zero and less than or equal to Le20. By using a matching circuit such as an inductor, L20 can be reduced (i.e., the size of the feeding element 20 can be reduced).

Also, assuming $\lambda_0$ denotes the radio wave wavelength in vacuum at the resonant frequency $f_1$ of the fundamental mode of the radiating elements 30 and 40, a shortest distance x between the feeding element 20 and the radiating elements 30 and 40 is preferably less than or equal to $0.2\times\lambda_0$ (more preferably less than or equal to $0.1\times\lambda_0$, and more preferably less than or equal to $0.05\times\lambda_0$). By arranging the feeding element 20 and the radiating elements 30 and 40 to be spaced apart by the shortest distance x as described above, the total efficiency (antenna gain) of the radiating elements 30 and 40 may be improved.

Note that the shortest distance x refers to the linear distance between a portion of the feeding element 20 and portions of the radiating elements 30 and 40 that are closest to each other, is the linear distance between portions that are closest. Also, the orientations of the feeding element 20 and the radiating elements 30 and 40 are not particularly limited as long as the feeding element 20 and the radiating elements 30 and 40 are coupled through electromagnetic field coupling. That is, the feeding element 20 and the radiating elements 30 and 40 may or may not be intersecting one another as viewed from a given direction, and their intersection angles may be set to any arbitrary angle.

Also, in the dipole mode, a distance over which the feeding element 20 and the radiating elements 30 and 40 run parallel to each other spaced the shortest distance x apart is preferably less than or equal to 3/8 of the length of the radiating elements 30 and 40. More preferably, the distance is less than or equal to 1/4 of the length of the radiating elements, and more preferably less than or equal to 1/8 of the length of the radiating elements. In the loop mode, the distance is preferably less than or equal to 3/16 of the inner circumference of the loop formed by the radiating elements, more preferably less than or equal to ⅛ of the inner circumference, and more preferably less than or equal to 1/16 of the inner circumference. Also, in a monopole mode (described below), the distance is preferably less than or equal to ¾ of the length of radiating elements 160 and 170, more preferably ½ of the length of the radiating element, and more preferably ¼ of the length of the radiating elements. The position where the feeding element 20 and the radiating elements 30 and 40 are spaced apart by the shortest distance x corresponds to where coupling between the feeding element 20 and the radiating elements 30 and 40 is strong, and when the distance over which the feeding element 20 and the radiating elements 30 and 40 run parallel to each other spaced the shortest distance x apart is too long, strong coupling may occur at both a high impedance portion and a low impedance portion of the radiating elements 30 and 40, and as such, impedance matching may become difficult. Thus, to obtain strong coupling only at a region where there is little variation in the impedance of the radiating elements 30 and 40, the distance over which the feeding element 20 and the radiating elements 30 and 40 run parallel to each other spaced the shortest distance x apart is preferably arranged to be relatively short, and in this way, advantageous effects may be achieved in terms of impedance matching.

In FIG. 1, the shortest distance x corresponds to the shortest distance between the end portion 21 of the feeding element 20 and the end portion 33 of the radiating element 30 and the shortest distance between the end portion 21 of the feeding element 20 and the end portion 43 of the radiating element 40. The feeding portion 35 is positioned at the end portion 33 (and possibly a conductive portion of the radiating element 30 in the vicinity of the end portion 33), and the feeding portion 45 is positioned at the end portion 43 (and possibly a conductor portion of the radiating element 40 in the vicinity of the end portion 43).

In FIG. 1, the radiating element 30 is a radiating conductor that functions as an antenna that operates in diploe mode (e.g., λ/2 dipole antenna) by being fed at the feeding portion 35 by the feeding element 20 through noncontact feeding (in particular, feeding through electromagnetic field coupling). The same applies to the radiating element 40.

On the other hand, the feeding element 20 is a linear feeding conductor that is capable of feeding the radiating elements 30 and 40. Also, the feeding element 20 may be fed by the feeding point 11 and thereby function as an antenna operating in monopole mode (e.g., λ/4 monopole antenna).

The radiating element 30 has the feeding portion 35 positioned toward the end portion 33 with respect to the central portion 32, and in this way, high impedance electromagnetic field coupling between the radiating element 30 and the feeding element 20 may be realized. Similarly, the radiating element 40 has the feeding portion 45 positioned toward the end portion 43 with respect to a central portion 42, and in this way, high impedance electromagnetic field coupling between the radiating element 40 and the feeding element 20 may be realized.

In the state where the feeding element 20 is coupled to both the radiating elements 30 and 40 through high impedance electromagnetic field coupling, the directivity of the antenna 1 may be linearly symmetrical with respect to a YZ plane passing through the feeding element 20, provided the environment is uniform.

The impedance control unit 120 includes an impedance variable unit that interconnects the feeding element 20 and the control element 50, and an impedance variable unit that interconnects the feeding element 20 and the control element 60. The impedance variable unit is for varying the impedance between the feeding element and the control element from low impedance to high impedance or from high impedance to low impedance. For example, an impedance adjusting unit that is capable of adjusting the impedance may be used as the impedance variable unit.

The impedance variable unit may be, for example, a switch that is capable of selectively switching the impedance between the feeding element and the control element to either low impedance or high impedance. For example, when the switch is turned on, the impedance between the feeding element and the control element may be switched to low impedance, and when the switch is turned off, the impedance between the feeding element and the control element may be switched to high impedance. Alternatively, the impedance variable unit may be configured to continuously change the impedance between the feeding element and the control element in an increasing direction or a decreasing direction, for example.

The control element 50 may be arranged such that when the impedance of the impedance variable unit between the control element 50 and the feeding element 20 at the resonant frequency of the radiating element 30 is decreased, the electromagnetic field coupling between the feeding element 20 and the radiating element 30 is weakened and the function of the radiating element 30 as a radiating conductor is degraded, for example. The control element 50 may be arranged such that when the impedance variable unit between the control element 50 and the feeding element 20 is set to low impedance, the electromagnetic field coupling between the feeding element 20 and the radiating element 30 may be weakened such that the radiating element 30 loses its function as a radiating conductor, for example. In FIG. 1, the control element 50 is arranged such that a high impedance portion of the control element 50 and a low impedance portion of the radiating element 30 at the resonant frequency of the radiating element 30 are positioned close to each other. Note that the high impedance portion of the control element 50 may correspond to an end portion 51, for example, and the low impedance portion of the radiating element 30 may correspond to the central portion 32, for example.

The control element 60 may be arranged in a manner similar to the control element 50. For example, the control element 60 may be arranged such that when the impedance of the impedance variable unit between the control element 60 and the feeding element 20 at the resonant frequency of the radiating element 40 is decreased, the electromagnetic field coupling between the feeding element 20 and the radiating element 40 is weakened and the function of the radiating element 40 as a radiating conductor is degraded. For example, the control element 60 may be arranged such that when the impedance variable unit between the control element 60 and the feeding element 20 is set to low impedance, the electromagnetic field coupling between the feeding element 20 and the radiating element 40 is weakened such that the radiating element 40 loses its function as a radiating conductor, for example. In FIG. 1, the control element 60 is arranged such that a high impedance portion of the control element 60 and a low impedance portion of the radiating element 40 at the resonant frequency of the radiating element 40 are positioned close to each other. Note that the high impedance portion of the control element 60 may correspond to an end portion 61, for example, and the low impedance portion of the radiating element 40 may correspond to the central portion 42, for example.

In the antenna 1 having the feeding element 20 coupled to a high impedance portion of the radiating element 30 (feeding portion 35) through electromagnetic field coupling, the impedance control unit 120 establishes low impedance connection between the feeding element 20 and the control element 50. By establishing low impedance connection between the feeding element 20 and the control element 50 via the impedance control unit 120, the electromagnetic field coupling between the feeding element 20 and the radiating element 30 is weakened. That is, because the end portion 51 corresponding to a high impedance portion of the control element 50 and the central portion 32 corresponding to a low impedance portion of the radiating element 30 at the resonant frequency of the radiating element 30 are arranged close to each other, by establishing low impedance connection between the feeding element 20 and the control element 50, the electromagnetic field coupling between the feeding element 20 and the radiating element 30 may be weakened. Similarly, in the antenna 1 having the feeding element 20 coupled to a high impedance portion of the radiating element 40 (feeding portion 45) through electromagnetic field coupling, the impedance control unit 120 establishes low impedance connection between the feeding element 20 and the control element 60. By establishing low impedance connection between the feeding element 20 and the control element 60 via the impedance control unit 120, the electromagnetic field coupling between the feeding element 20 and the radiating element 40 may be weakened.

Thus, when the feeding element 20 is coupled to both the radiating element 30 and the radiating element 40 through electromagnetic field coupling, the electromagnetic field coupling between the feeding element 20 and the radiating element 30 may be weakened by establishing low impedance connection between the feeding element 20 and the control element 50. In this way, the antenna gain of the radiating element 30 may become smaller than the antenna gain of the radiating element 40 and the radiation from the radiating element 40 may become dominant such that the directivity of the antenna 1 may be altered and controlled. Similarly, when the feeding element 20 is coupled to both the radiating element 30 and the radiating element 40 through electromagnetic field coupling, by establishing low impedance connection between the feeding element 20 and the control element 60, the electromagnetic field coupling between the feeding element 20 and the radiating element 40 may be weakened. In this way, the antenna gain of the radiating element 40 may become smaller than the antenna gain of the radiating element 30 and the radiation from the radiating element 30 may become dominant such that the directivity of the antenna 1 may be altered and controlled.

Also, by weakening the electromagnetic field coupling between the radiating element 30 and the feeding element 20 and the electromagnetic field coupling between the radiating element 40 and the feeding element 20, the antenna gain of both the radiating element 30 and the radiating element 40 may be reduced. In this way, the SAR (Specific Absorption Rate) of the antenna 1 and a wireless device equipped with the antenna 1 may be reduced, and their impact on the human body may be reduced, for example.

Thus, by arranging the antenna 1 to have the above-described configuration, the directivity of the antenna 1 may be switched and controlled without having the feeding element 20 arranged in contact with the radiating element 30 or the radiating element 40.

Note that in FIG. 1, the control element 50 overlaps with the radiating element 30 in plan view from a direction parallel to the Z-axis. However, the control element 50 does not necessarily have to be arranged to overlap with the radiating element 30 in plan view from the direction parallel to the Z-axis as long as the control element 50 is arranged at a suitable position such that low impedance connection may be established between the feeding element 20 and the control element 50 to thereby weaken the electromagnetic field coupling between the feeding element 20 and the radiating element 30. For example, the control element 50 may be arranged to overlap with the radiating element 30 in plan view from any direction such as a direction parallel to the X-axis or the Y-axis. Note that the same applies to the overlapping relationship between the control element 60 and the radiating element 40.

The impedance control unit 120 may include an impedance adjusting unit 121 that is configured to lower the impedance between the feeding element 20 and the control element 50 to thereby degrade the function of the radiating element 30 as a radiating conductor, for example. The impedance adjusting unit 121 may be configured to lower the impedance between the feeding element 20 and the control element 50 close to zero to thereby weaken the electromagnetic field coupling between the radiating element 30 and the feeding element 20, for example. Note that the impedance adjusting unit 121 is an example of the impedance variable unit that is capable of increasing or decreasing the impedance between the feeding element 20 and the control element 50, and may be implemented by an element such as a variable capacitance diode or a circuit including such an element, for example. The impedance adjusting unit 121 may be capable of gradually changing (decreasing or increasing) the impedance between the feeding element 20 and the control element 50 and thereby continuously change the directivity of the antenna 1, for example. Note that the impedance control unit 120 may also be configured to switch and control the directivity of the antenna 1 by turning on/off a switch element such as a transistor included in the impedance adjusting unit 121.

By controlling the impedance between the feeding element 20 and the control element 50 to low impedance (e.g., ON), the impedance adjusting unit 121 may increase the RF current flowing between the feeding element 20 and the control element 50. In this way, the electromagnetic field coupling between the radiating element 30 and the feeding element 20 that is connected to the control element 50 with low impedance may be weakened, and the function of the radiating element 30 as a radiating conductor may be degraded. Conversely, by controlling the impedance between the feeding element 20 and the control element 50 to high impedance (e.g., OFF), the impedance adjusting unit 121 may reduce or stop the RF current flowing between the feeding element 20 and the control element 50. In this way, the radiating elements 30 may be coupled to the feeding element 20 through electromagnetic field coupling.

Similarly, the impedance control unit 120 may include an impedance adjusting unit 122 that is configured to lower the impedance between the feeding element 20 and the control element 60 to thereby degrade the function of the radiating element 40 as a radiating conductor, for example. The impedance adjusting unit 122 may be configured to lower the impedance between the feeding element 20 and the control element 60 close to zero to thereby weaken the electromagnetic field coupling between the radiating element 40 and the feeding element 20, for example. Note that features and functions of the impedance adjusting unit 122 may be substantially identical to those of the impedance adjusting unit 121, and as such, detailed descriptions thereof will be omitted.

Figure 3:
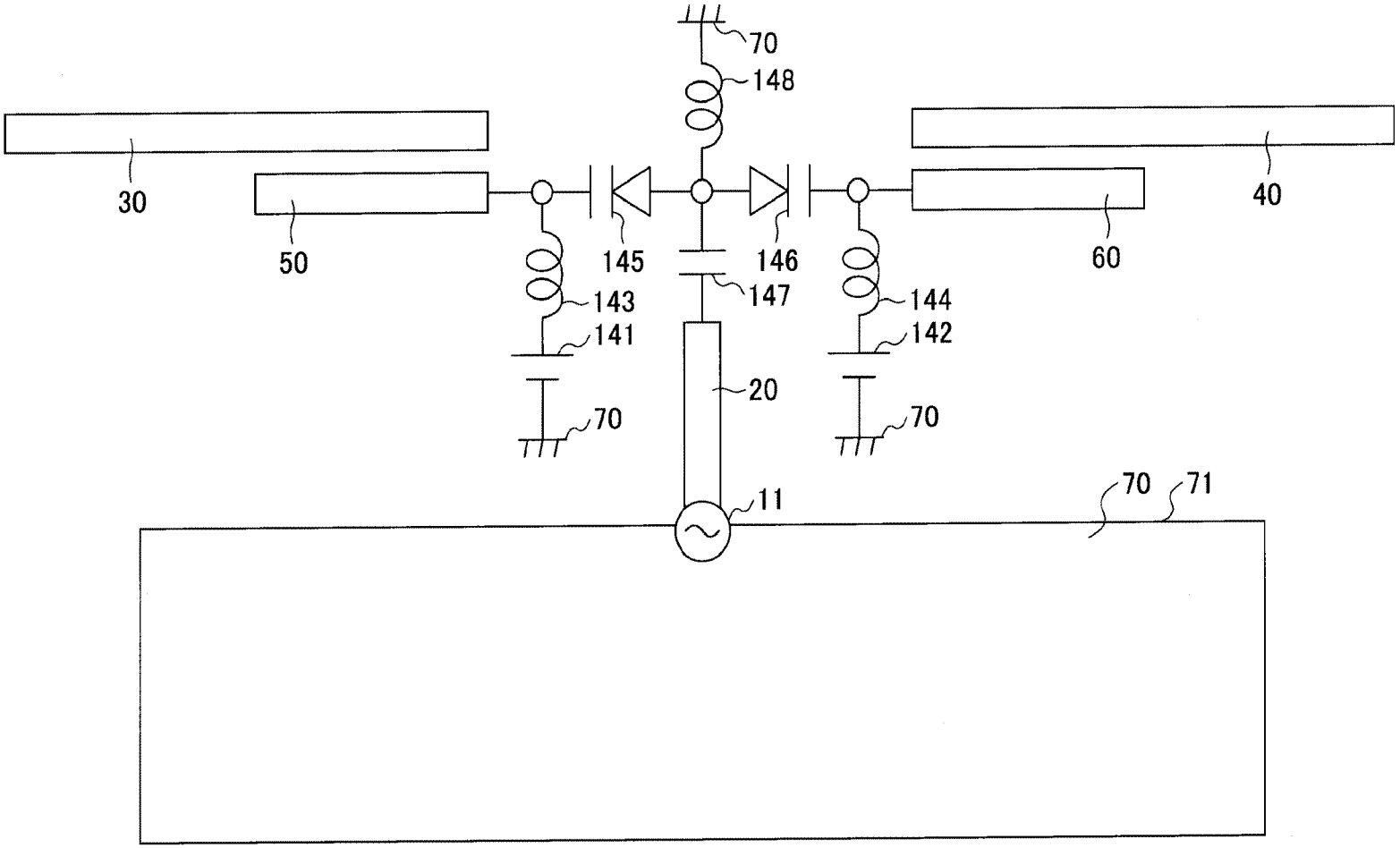
FIG. 3 is a diagram illustrating an exemplary configuration of an impedance control unit of the antenna according to the first embodiment.

FIG. 3 is a diagram illustrating an exemplary configuration of the impedance control unit 120. The impedance control unit 120 includes a capacitor 147, inductors 143, 144, and 148, variable capacitances diode 145 and 146, and DC voltage sources 141 and 142.

The capacitor 147 and the inductor 148 are connected in series, one end of the capacitor 147 is connected to the end portion 21 of the feeding element 20, and one end of the inductor 148 is connected to the ground plane 70. One end of the control element 50 is connected to an intermediate connection point between the capacitor 147 and the inductor 148 via the variable capacitance diode 145, and one end of the control element 60 is connected to the intermediate connection point between the capacitor 147 and the inductor 148 via the variable capacitance diode 146. The inductor 143 and the DC voltage source 141 are connected in series, one end of the inductor 143 is connected to an intermediate connection point between the variable capacitance diode 145 and the control element 50, and one end of the DC voltage source 141 is connected to the ground plane 70. The inductor 144 and the DC voltage source 142 are connected in series, one end of the inductor 144 is connected to an intermediate connection point between the variable capacitance diode 146 and the control element 60, and one end of the DC voltage source 142 is connected to the ground plane 70.

When the DC voltage source 141 increases its DC voltage output, the capacitance of the variable capacitance diode 145 decreases, and as a result, the impedance between the feeding element 20 and the control element 50 increases such that the RF current flowing through the control element 50 may be reduced or stopped. In this way, the connection between the feeding element 20 and the control element 50 may be weakened or disconnected such that the radiating element 30 that is coupled to the feeding element 20 through electromagnetic field coupling may be able to implement its function as a radiating conductor.

Conversely, when the DC voltage source 141 decreases or stops its DC voltage output, the capacitance of the variable capacitance diode 145 increases, and as a result, the impedance between the feeding element 20 and the control element 50 decreases such that the RF current flowing through the control element 50 may be increased. In this way, the connection between the feeding element 20 and the control element 50 may be strengthened such that the function of the radiating element 30, which is electromagnetically coupled to the feeding element 20, as a radiating conductor may be suppressed or blocked, for example.

Similarly, when the DC voltage source 142 increases its DC voltage output, the capacitance of the variable capacitance diode 146 decreases, and as a result, the impedance between the feeding element 20 and the control element 60 increases, such that the RF current flowing through the control element 60 may be reduced or stopped. In this way, the connection between the feeding element 20 and the control element 60 may be weakened or disconnected such that the radiating element 40 that is coupled to the feeding element 20 through electromagnetic field coupling may implement its function as a radiating conductor.

Conversely, when the DC voltage source 142 decreases or stops its DC voltage output, the capacitance of the variable capacitance diode 146 increases, and as a result, the impedance between the feeding element 20 and the control element 60 decreases such that the RF current flowing through the control element 60 may be increased. In this way, the connection between the feeding element 20 and the control element 60 may be strengthened such that the function of the radiating element 40, which is electromagnetically coupled to the feeding element 20, as a radiating conductor may be suppressed or blocked, for example.

By using the impedance control unit 120 as illustrated in FIG. 3, the impedance between the feeding element 20 and the control element 50 and the impedance between the feeding element 20 and the control element 60 may be gradually changed (decreased or increased), for example. By gradually changing the impedance, the directivity of the antenna 1 may be controlled to gradually change according to changes in the surrounding environment, for example, rather than controlling the directivity through on/off switching.

Figure 4:
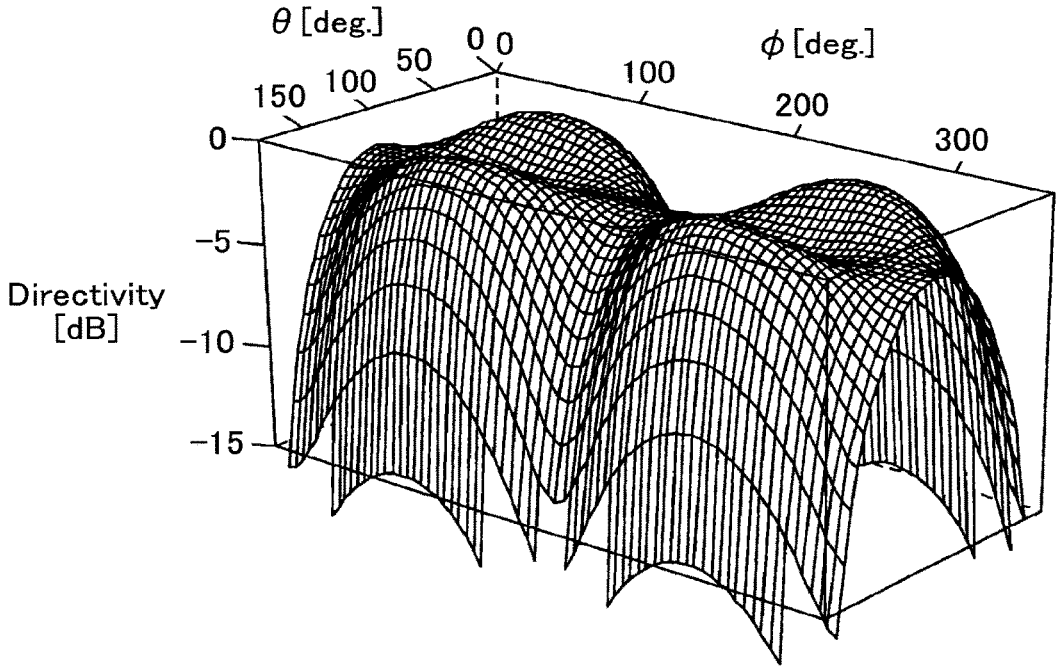
FIG. 4 is a diagram illustrating a directivity of the antenna according to the first embodiment in one exemplary case.
Figure 5:
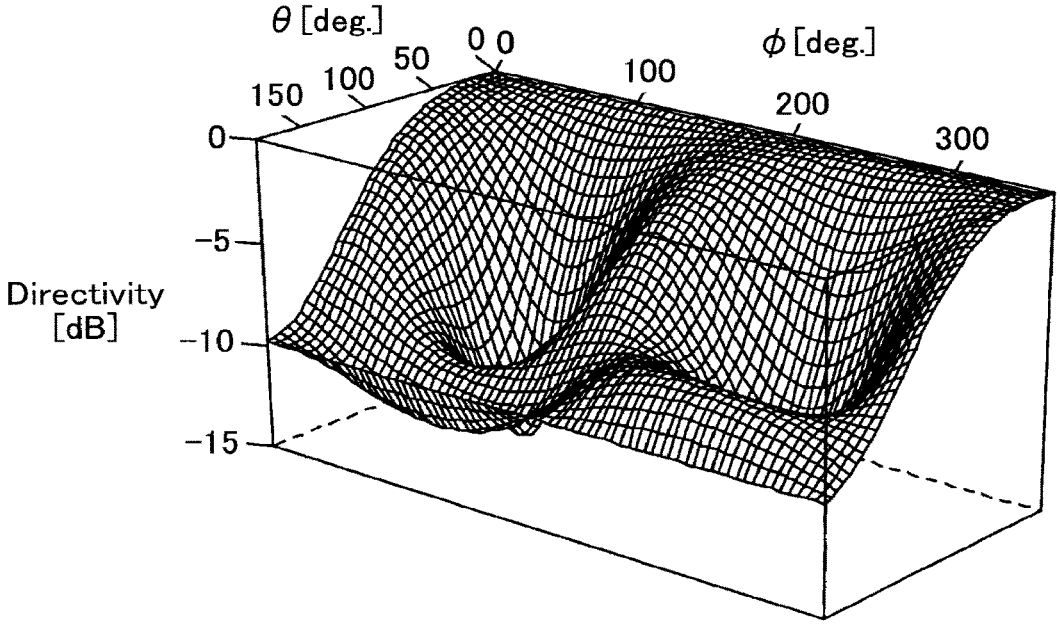
FIG. 5 is a diagram illustrating a directivity of the antenna according to the first embodiment in another exemplary case.

FIGS. 4 and 5 are diagrams illustrating the directivity of the antenna 1. In FIGS. 4 and 5, "directivity" represents the directional gain at the resonant frequency of the fundamental mode of the antenna 1 (1.485 GHz in the present example), θ represents an angle formed with respect to the extending direction of the feeding element 20 within a YZ plane that passes through the feeding portion 11 and a center point of the ground plane 70, and ϕ represents an angle formed with respect to a normal direction of the ground plane 70 within the ZX plane passing through the center point of the ground plane 70 (see FIG. 1).

FIG. 4 illustrates the directivity of the antenna 1 in a case where the impedance between the feeding element 20 and the control element 50 is high, and the impedance between the feeding element 20 and the control element 60 is also high. FIG. 5 illustrates the directivity of the antenna 1 in a case where the impedance between the feeding element 20 and the control element 50 is high, and the impedance between the feeding element 20 and the control element 60 is low. As can be appreciated from FIGS. 4 and 5, the directivity of the antenna 1 can be switched.

The antenna 1 has a symmetrical configuration with respect to the YZ plane passing through the feeding point 11. Thus, in a case where the impedance between the feeding element 20 and the control element 50 is low, and the impedance between the feeding element 20 and the control element 60 is high, as opposed to the case of FIG. 5, the antenna 1 may have a directivity that is line symmetrical, with respect to ϕ=180°, to the directivity illustrated in FIG. 5.

In FIG. 1, the antenna 1 may include a matching circuit 90 that operates in conjunction with the impedance control unit 120 to adjust the resonant frequency in the fundamental mode of the radiating element 30 and the radiating element 40, for example. The matching circuit 90 may adjust the resonant frequency in conjunction with the operation of the impedance control unit 120 altering the coupling state between the radiating element 30 and the feeding element 20 or the coupling state between the radiating element 40 and the feeding element 20, for example. The matching circuit 90 may be inserted into or connected to the feeding element 20, for example.

By using the matching circuit 90, even when the resonant frequency of the fundamental mode of the radiating element 30 or the radiating element 40 changes as a result of a change in the coupling state between the radiating element 30 and the feeding element 20 or the coupling state between the radiating element 40 and the feeding element 20, the matching circuit 90 may correct such change in the resonant frequency, for example.

Figure 6:
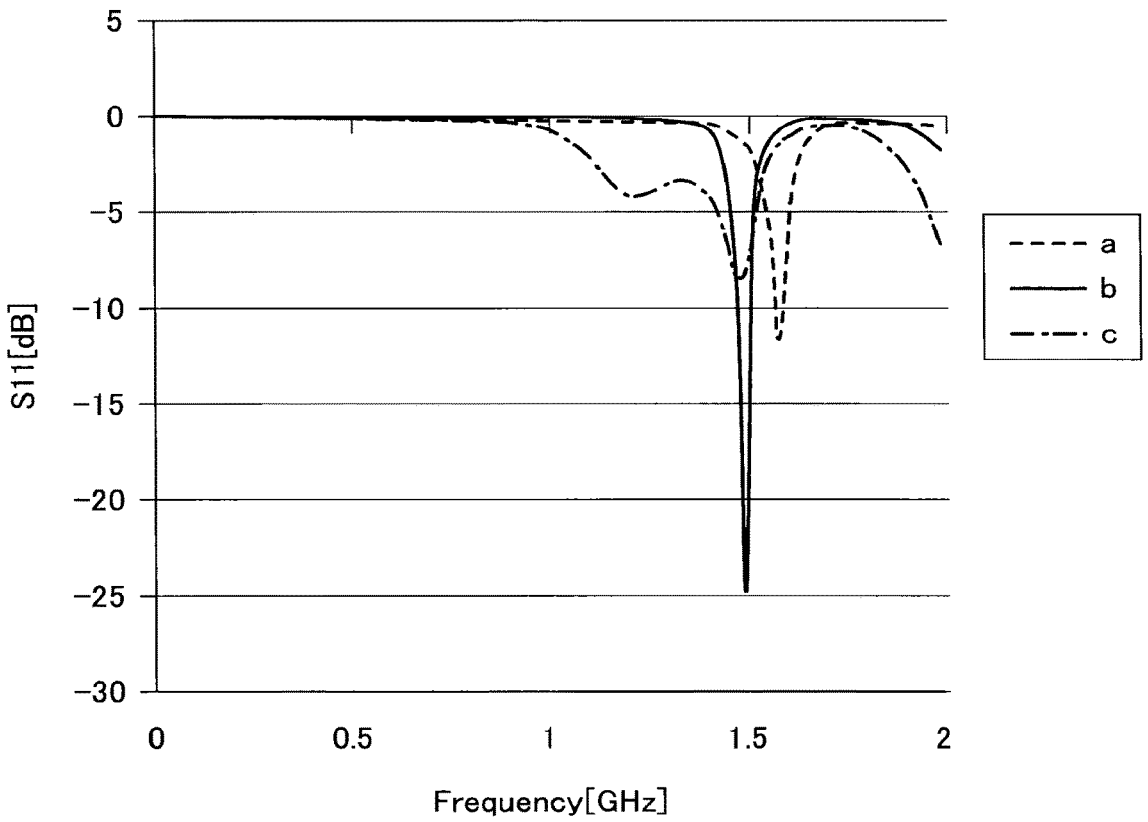
FIG. 6 is a graph indicating S11 measurements for illustrating an effect of a matching circuit of the antenna according to the first embodiment.

FIG. 6 is a graph indicating S11 characteristic measurements of the antenna 1 for illustrating an effect of the matching circuit 90. In the graph of FIG. 6, "a" represents a case where no matching circuit 90 is used, the impedance between the feeding element 20 and the control element 50 is high, and the impedance between the feeding element 20 and the control element 60 is high (i.e., impedance adjusting unit 121: high impedance; impedance adjusting unit 122: high impedance). Also, "b" represents a case where the matching circuit 90 is used, the impedance between the feeding element 20 and the control element 50 is high, and the impedance between the feeding element 20 and the control element 60 is high (i.e., impedance adjusting unit 121: high impedance; impedance adjusting unit 122: high impedance). Also, "c" represents a case where no matching circuit 90 is used, the impedance between the feeding element 20 and the control element 50 is high, and the impedance between the feeding element 20 and the control element 60 is low (i.e., impedance adjusting unit 121: high impedance; impedance adjusting unit 122: low impedance).

Note that FIG. 6 illustrates an example where the matching circuit 90 includes an inductor (inductance: 15 nH) that is serially inserted to the feeding element 20 and an inductor (inductance: 15 nH) that is inserted between the end portion 21 of the feeding element 20 and the ground plane 70.

If the matching circuit 90 is not operated when the impedance adjusting unit 122 is switched from ON to OFF, the resonant frequency of the fundamental mode of the radiating element 30 (1.485 GHz in the present example) may deviate in some cases (e.g., change from "c" to "a" in FIG. 6). However, by operating the matching circuit 90 in conjunction with the operation of switching the impedance adjusting unit 122 from ON to OFF, such a deviation of the resonant frequency of the fundamental mode of the radiating element 30 may be prevented (e.g., change from "c" to "b").

Note that upon obtaining the S11 characteristic measurements, the dimensions L11-L16 of the configuration illustrated in FIG. 1 were set up as follows (in mm).

L11: 60
L12: 30
L13: 130
L14: 10.5
L15: 58
L16: 30

Also, the line widths of the feeding element 20, the radiating elements 30 and 40, the control elements 50 and 60 were set to 1 mm.

Also, upon obtaining the S11 characteristic measurements, the dimensions of the configuration illustrated in FIG. 2 were set up as follows. That is, the substrate 80 was set up to have a relative permittivity of $\in_r$=3.3, a loss tangent of tan δ=0.003, and a thickness of H1=0.8 mm; and the substrate 110 was set up to have a relative permittivity of $\in_r$=7.44, a loss tangent of tan δ=0.011, and a thickness of H3=1.1 mm. Also, the gap between the substrate 80 and the substrate 110 was set up to be H2=2 mm.

<Antenna Device 201>

Figure 7:
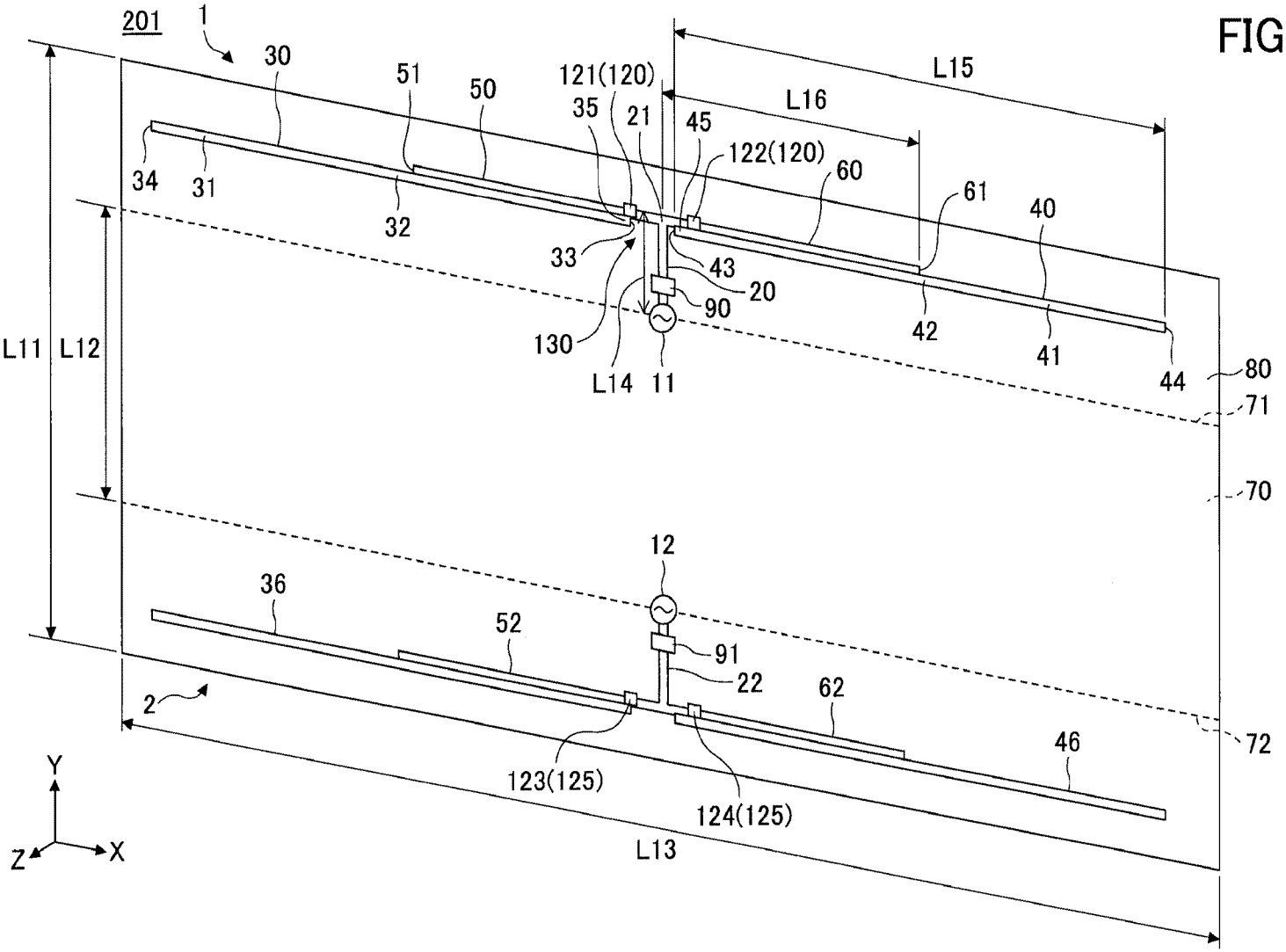
FIG. 7 is a perspective view of an exemplary analysis model of an antenna device including a plurality of antennas according to a second embodiment of the present invention.

FIG. 7 is a perspective view of a computer simulation model for analyzing the operation of an antenna device 201 including antennas 1 and 2 according to a second embodiment of the present invention. Note that in the present example, CST Microwave Studio (registered trademark) by Computer Simulation Technology AG (CST) was used as an electromagnetic field simulator. Also, note that descriptions of features of the present embodiment that may be substantially identical to those of the embodiment described above may be simplified or omitted.

The antenna 2 of the antenna device 201 may have a configuration that is substantially identical to the configuration of the antenna 1, and is arranged on the opposite side of the antenna 1 with respect to the ground plane 70. The antenna 2 includes a feeding element 22, a radiating element 36, a radiating element 46, a control element 52, a control element 62, an impedance control unit 125, and a matching circuit 91.

The feeding element 22 is a conductor that uses the ground plane 70 as a ground reference and is connected to a feeding point 12. The feeding point 12 may be arranged at a central portion of an outer edge 72 of the ground plane 70, for example. The outer edge 72 is located at the opposite side of the outer edge 71 with respect to the central portion of the ground plane 70.

The radiating element 36 and the radiating element 46 are both coupled to the feeding element 22 through electromagnetic field coupling. The control element 52 is spaced apart from the radiating element 36 in a direction parallel to the Z-axis, and the control element 62 is spaced apart from the radiating element 46 in a direction parallel to the Z-axis.

The impedance control unit 125 is an example of a control unit that controls an impedance variable unit to establish low impedance connection between the feeding element 22 and the control element 52, or between the feeding element 22 and the control element 62. The impedance control unit 125 may include an impedance adjusting unit 123 that may be substantially identical to the impedance adjusting unit 121 described above. For example, the impedance adjusting unit 123 may be configured to lower the impedance between the feeding element 22 and the control element 52 to thereby weaken the electromagnetic field coupling between the radiating element 36 and the feeding element 22. Similarly, the impedance control unit 125 may include an impedance adjusting unit 124 that may be substantially identical to the impedance adjusting unit 122 described above. For example, the impedance adjusting unit 124 may be configured to lower the impedance between the feeding element 22 and the control element 62 to thereby weaken the electromagnetic field coupling between the radiating element 46 and the feeding element 22.

The matching circuit 91 may be similar to the matching circuit 90 as described above. That is, the matching circuit 91 may operate in conjunction with the operation of the impedance control unit 125 to adjust the resonant frequency of the fundamental mode of the radiating element 36 and the radiating element 46.

By including the antennas 1 and 2, the antenna device 201 may function as a MIMO (Multiple Input Multiple Output) antenna. Also, the antenna device 201 may be capable of switching and controlling the directivity of each of the antennas 1 and 2 while maintaining the correlation coefficient between the antenna 1 and the antenna 2 at a desirably low value regardless of the impedances set up by the impedance adjusting units 121, 122, 123, and 124.

<Antenna 3>

Figure 8:
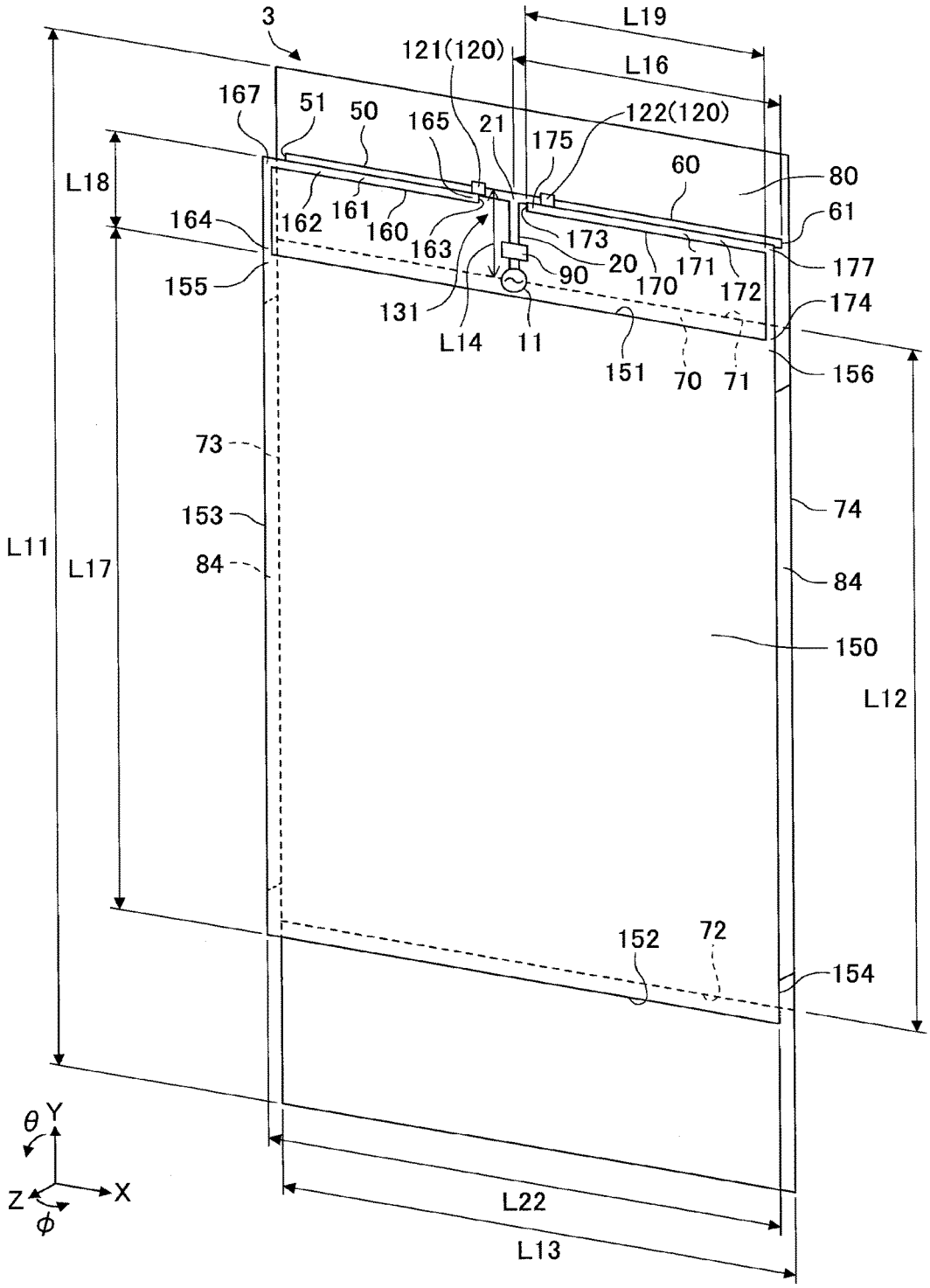
FIG. 8 is a perspective view of an exemplary analysis model of an antenna according to a third embodiment of the present invention.

FIG. 8 is a perspective view of a computer simulation model for analyzing the operation of an antenna 3 according to a third embodiment of the present invention. Note that in the present example, CST Microwave Studio (registered trademark) by Computer Simulation Technology AG (CST) was used as an electromagnetic field simulator. Also, note that descriptions of features of the present embodiment that may be substantially identical to those of the embodiments described above may be simplified or omitted.

The antenna 3 includes a ground plane 70, a plate conductor 150, a feeding element 20, a radiating element 160, a radiating element 170, a control element 50, a control element 60, an impedance control unit 120, and optionally, a matching circuit 90. Note that the feeding element 20, the control element 50, the control element 60, the impedance control unit 120, and the matching circuit 90 may be substantially identical to those described above with reference to FIG. 1.

The ground plane 70 is a planar ground pattern having at least one side as an outer edge. In FIG. 8, the ground plane 70 is arranged into a rectangular shape extending in the XY plane. In FIG. 8, the ground plane 70 includes an outer edge 71 that extends linearly in the X-axis direction, an outer edge 73 that extends linearly in the Y-axis direction, an outer edge 72 opposing the outer edge 71 and extending in the X-axis direction, and an outer edge 74 opposing the outer edge 73 and extending in the Y-axis direction.

The plate conductor 150 is a flat conductor arranged parallel to the ground plane 70 and spaced apart from the ground plane 70 in a direction parallel to the Z-axis. In FIG. 8, the plate conductor 150 is arranged into a polygonal shape extending in the XY plane and having outer edges 151, 152, 153 and 154.

By arranging the plate conductor 150 to have at least one outer edge extending along at least one outer edge of the ground plane 70, resonance between the plate conductor 150 and the ground plane 70 may be facilitated, and the number of resonance of the antenna 3 may be increased. In FIG. 8, the outer edges 151, 152, 153 and 154 of the plate conductor 150 are respectively arranged to run parallel with the outer edges 71, 72, 73 and 74 of the ground plane 70. Note that the outer edge 151 may be arranged to overlap with the position of the outer edge 71 in a plan view from a direction parallel to the Z-axis or be offset from the position of the outer edge 71. The same applies to the outer edges 152, 153, and 154.

The plate conductor 150 includes a portion spaced apart from the ground plane 70 in a direction parallel to the Z-axis and facing the ground plane 70. In FIG. 8, the plate conductor 150 is arranged into a rectangular conductor that is spaced apart from the ground plane 70 by a distance that enables high frequency coupling between the plate conductor 150 and the ground plane 70. The plate conductor 150 includes the outer edge 151 that linearly extends in the X-axis direction, the outer edge 153 that linearly extends in the Y-axis direction, the outer edge 153 that opposes the outer edge 151 and linearly extends in the X-axis direction, and the outer edge 154 that opposes the outer edge 153 and linearly extends in the Y-axis direction.

The feeding element 20 is a conductor that is spaced apart from the radiating element 160 and the radiating element 170 by a predetermined distance. The feeding element 20 may be spaced apart from the radiating element 160 and the radiating element 170 by a gap having a direction component parallel to the Z-axis.

In FIG. 8, the feeding element 20 overlaps with the radiating element 160 and the radiating element 170 in plan view from a direction parallel to the Z-axis. However, the feeding element 20 does not necessarily have to overlap with the radiating element 160 and the radiating element 170 in plan view from a direction parallel to the Z-axis as long as the feeding element 20 is spaced apart from the radiating element 160 and the radiating element 170 by a distance that enables the feeding element to perform noncontact feeding of the radiating element 160 and the radiating element 170. For example, the feeding element may be arranged to overlap with the radiating element 160 and the radiating element 170 in plan view from any direction such as a direction parallel to the X-axis or the Y-axis.

The feeding element 20 is a conductor that is capable of performing noncontact feeding of the radiating element 160 via the feeding portion 165 of the radiating element 160, performing noncontact feeding of the radiating element 170 via the feeding portion 175 of the radiating element 170.

In plan view from a direction normal to the ground plane 70, the feeding element 20 extends from the feeding point 11 to the end portion 21 in a direction toward a gap 131 between one end portion 163 of the radiating element 160 and one end portion 173 of the radiating element 170. The feeding element 20 includes the end portion 21 that is spaced apart from the end portion 163 of the radiating element 160 and the end portion 173 of the radiating element 170 by a predetermined distance, and the end portion 21 is positioned in the vicinity of the gap 131.

The radiating element 160 is a linear radiating conductor that is connected to the plate conductor 150 and protrudes from the outer edge 151 of the plate conductor 150 in an opposite direction from the plate conductor 150. The radiating element 160 is arranged such that at least a portion of the radiating element 160 does not overlap with the ground plane in plan view from a direction parallel the Z-axis. The radiating element 160 includes the end portion 163 and another end portion 164, and is arranged into an L-shape that extends from one end portion 164 to the other end portion 163 via a bent portion 167. The end portion 164 is a root portion that is connected to a portion of the plate conductor 150 in the vicinity of one end portion 155 of the outer edge 151 of the plate conductor 150, and the end portion 163 is an open end that is not connected to another conductor.

The radiating element 160 may include a linear radiating conductor portion that is arranged along the outer edge 71 of the ground plane 70, for example. The radiating element 160 may include a conductor portion 161 that is arranged opposite the outer edge 71 of the ground plane 70 and extends in a direction parallel to the outer edge 71 while being spaced apart from the outer edge 71 by a predetermined shortest distance, for example. Note that a direction parallel to the outer edge 71 corresponds to a direction parallel to the X axis in FIG. 8. By arranging the radiating element 160 to include the conductor portion 161 extending along the outer edge 71, the directivity of the antenna 3 may be more easily controlled, for example.

Note that although FIG. 8 illustrates an example where the radiating element 160 is arranged into an L-shape within the XY plane, the radiating element 160 may be in other shapes such as linear shape. Also, the radiating element 160 may include a conductor portion extending in the XY plane and a conductor portion extending in a plane other than the XY plane, for example.

The radiating element 170 may have the same or similar configuration as the radiating element 160, and as such, descriptions thereof are simplified. The radiating element 170 is an antenna conductor that includes one end portion 174 and another end portion 173, and is arranged into an L-shape extending from the end portion 174 to the end portion 173 via a bent portion 177. The end portion 174 is a root portion that is connected to a portion of the plate conductor 150 in the vicinity of an end portion 156 of the outer edge 151 of the plate conductor 150, and the end portion 173 is an open end that is not connected to another conductor. The radiating element 170 may include a conductor portion 171 that is arranged opposite the outer edge 71 of the ground plane 70 and extends in a direction parallel to the outer edge 71 while being spaced apart from the outer edge 71 by a predetermined shortest distance, for example.

The radiating element 170 and the radiating element 160 are conductors extending in different directions from each other, in directions toward the feeding element 20. Note that although FIG. 8 illustrates an example where the radiating element 170 and the radiating element 160 are conductors arranged in the same XY plane, the radiating element 170 and the radiating element 160 may alternatively be conductors arranged in different planes, for example. Also, although FIG. 8 illustrates an example where the conductor portion 171 of the radiating element 170 and the conductor portion 161 of the radiating element 160 are arranged along a single straight line, the conductor portions 161 and 171 may alternatively be arranged on different straight lines, for example.

Also, although FIG. 8 illustrates an example where the radiating element 160 and the feeding element 20 overlap in plan view from the Z-axis direction, the radiating element 160 and the feeding element 20 do not necessarily have to overlap in plan view from the Z-axis direction as long as the feeding element 20 is spaced apart from the radiating element 160 by an adequate distance to enable electromagnetic field coupling between the feeding element 20 and the radiating element 160. For example, the radiating element 160 and the feeding element 20 may overlap in plan view from any direction such as the X-axis or the Y-axis direction.

The feeding element 20 and the radiating element 160 may be spaced apart from each other by a certain distance so as to enable high frequency coupling between the radiating element 160 and the feeding element 20. Noncontact feeding of the radiating element 160 may be implemented via the feeding element 20. By feeding the radiating element 160 in this manner, the radiating element 160 may function as a radiating conductor of an antenna. As illustrated in FIG. 8, in the case where the radiating element 160 is arranged into a linear conductor having one end connected to the plate conductor 150 having a large area and another end corresponding to an open end, a resonant current (standing wave current distribution) similar to that formed in a $\lambda/4$ monopole antenna may be formed on the radiating element 160. That is, the radiating elements 160 may function as a monopole antenna that resonates at a quarter wavelength of a predetermined frequency (hereinafter referred to as "monopole mode").

The radiating element 170 may have the same or similar configuration as the radiating element 160, and as such descriptions thereof are simplified. The feeding element 20 and the radiating element 170 may be spaced apart by a certain distance so as to enable electromagnetic field coupling between these elements. Noncontact feeding of the radiating element 170 may be implemented via the feeding element 20. By feeding the radiating element 170 in this manner, the radiating element 170 may function as a radiating conductor of an antenna.

Also, assuming Le160 and Le170 denote the electrical lengths that impart the fundamental mode of resonance to the radiating elements 160 and 170, and $\lambda$ denotes the wavelength on the radiating elements 160 and 170 at the resonant frequency $f_1$ of the fundamental mode of the radiating elements 160 and 170, Le160 and Le170 are greater than or equal to $(1/8)\lambda$ and less than or equal to $(3/8)\lambda$.

Also, in a case where the fundamental mode of resonance of the radiating elements corresponds to the monopole mode (i.e., the radiating elements are connected to the outer edge of the plate conductor and have open ends), Le160 and Le170 are preferably greater than or equal to $(1/8)\lambda$ and less than or equal to $(3/8)\lambda$, more preferably greater than or equal to $(3/16)\lambda$ and less than or equal to $(5/16)\lambda$, and more preferably greater than or equal to $(7/32)\lambda$ and less than or equal to $(9/32)\lambda$. By arranging Le160 and Le170 to be within the above ranges, the radiating elements 160 and 170 may adequately function as radiating conductors, and the antenna 3 may achieve desirably high efficiency, for example.

Also, assuming L160 and L170 denote the physical lengths of the radiating elements 160 and 170 (corresponding to L18+L19 in FIG. 8), $\lambda_0$ denotes the radio wave wavelength in vacuum at the resonant frequency of the fundamental mode of the radiating elements, and $k_2$ denotes a shortening coefficient of a wavelength shortening effect in an actual environment, L160 and L170 are determined by $\lambda_{g2}=\lambda_0 k_2$. Here, $k_2$ is calculated based on, for example, a relative permittivity and a relative permeability such as an effective relative permittivity ($\in_{r2}$) and an effective relative permeability ($\mu_{r2}$) of a medium (environment) such as a dielectric substrate at which the radiating elements 160 and 170 are arranged, the thickness of the medium (environment), and the resonant frequency. That is, in the case where the fundamental mode of resonance of the radiating elements corresponds to the monopole mode, L160 and L170 is greater than or equal to $(1/8)\lambda_{g2}$ and less than or equal to $(3/8)\lambda_{g2}$. The physical lengths L160 and L170 of the radiating elements 160 and 170 are physical lengths that give Le160 and Le170. In an ideal case where no other factor is considered, the physical lengths L160 and 170 are equal to Le160 and Le170. Note that even when a matching circuit such as an inductor is used to shorten the physical lengths L160 and L170 (i.e., reduce the size of the radiating elements 160 and 170), the physical lengths L160 and L170 are preferably greater than zero and less than or equal to Le160 and Le170, and more preferably greater than or equal to 0.4×Le160 and 0.4×Le170, and less than or equal to Le160 and Le170.

In FIG. 8, the feeding portions 165 and 175, which correspond to portions of the radiating elements 160 and 170 that are fed by the feeding element 20, are arranged at positions toward the end portions 163 and 173 and away from the end portions 164 and 174, which correspond to low impedance portions of the radiating elements 160 and 170 that are connected to the plate conductor 150 and have the lowest impedance at the resonant frequency of the fundamental mode of the radiating elements 160 and 170. In this way, impedance matching of the antenna 3 may be facilitated. In particular, the feeding portions 165 and 175 are preferably arranged at positions toward the end portions 163 and 173 from the central portions 162 and 172. Note that the feeding portions 165 and 175 are defined by portions closest to the feeding point 11 of the conductor portions of the radiating elements 160 and 170 closest to the feeding element 20. Also, note that the feeding portions 165 and 175 are feeding portions for the radiating elements 160 and 170, respectively, and are not feeding portions for the antenna 3. That is, the feeding point 11 functions as the feeding portion for the antenna 3 in the present example.

In the monopole mode, the impedance of the radiating elements 160 and 170 increases from the end portions 164 and 174 toward the end portions 163 and 173 of the radiating elements 160 and 170. In the case of implementing high impedance coupling between the feeding element 20 and the radiating elements 160 and 170 through electromagnetic field coupling, even when slight variations occur in the impedance between the feeding element 20 and the radiating elements 160 and 170, their impact on impedance matching may be relatively small as long as the feeding element 20 and the radiating elements 160 and 170 are coupled at a sufficiently high impedance of at least a certain level. Thus, to facilitate matching, the feeding portions 165 and 175 of the radiating elements 160 and 170 are preferably positioned at high impedance portions of the radiating elements 160 and 170.

For example, to facilitate impedance matching of the antenna 3, the feeding portions 165 and 175 may be positioned at a region spaced apart from the region having the lowest impedance at the resonant frequency of the fundamental mode of the radiating elements 160 and 170 (end portions 164 and 174 in the present example) by a distance greater than equal to ¼ of the total length of the radiating elements 160 and 170 (preferably greater than or equal to ⅓ of the total length, and more preferably greater than or equal to ½ of the total length). Further, the feeding portions 165 and 175 are preferably arranged at positions toward the end portions 163 and 173 from the central portions 162 and 172. In FIG. 8, the total length of the radiating elements 160 and 170 correspond to L18+L19, and the feeding portions 165 and 175 are positioned toward the end portions 163 and 173 from the central portions 162 and 172.

In the antenna 3 having the above-described configuration, even when the plate conductor 150 having a relatively large area is arranged, because noncontact feeding of the radiating elements 160 and 170 by the feeding element 20 is implemented, restrictions on the configurations and layout of the radiating elements 160 and 170 and/or the feeding element 20 may be reduced. That is, as long as the feeding element 20 and the radiating elements 160 and 170 are spaced apart by a suitable distance that enables noncontact feeding of the radiating elements 160 and 170, the positional relationship between the feeding element 20 and the radiating elements 160 and 170 may be freely designed and functions of the antenna 3 may be implemented with relative ease.

Figure 9:
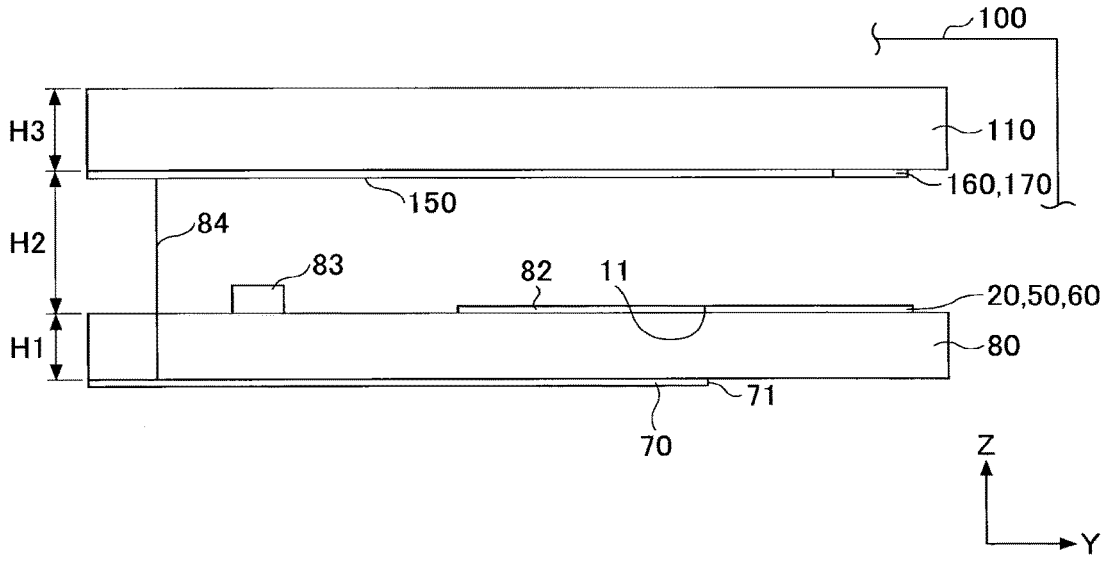
FIG. 9 is a diagram schematically illustrating an exemplary positional relationship between components of the antenna according to the third embodiment.

FIG. 9 schematically illustrates a positional relationship between components of the antenna 3 in the Z-axis direction. Note that descriptions of features and effects that may be substantially identical to those of the embodiments described above may be omitted or simplified. The feeding element 20 and the radiating elements 160 and 170 may be spaced apart from each other by a distance that enables electromagnetic field coupling, between these elements, for example.

The ground plane 70 and the plate conductor 150 may be DC coupled via a connection conductor 84, for example. Note that any number of connection conductors 84 may be provided. In a case where a heating element 83 is arranged on the substrate 80, heat emitted by the heating element 83 may be transferred to the plate conductor 150 via the substrate 80 and the connection conductor 84.

The plate conductor 150 is capable of functioning as a heat sink that dissipates heat. The plate conductor 150 may release the heat generated by the heating element 83 mounted on the substrate 80, or release heat generated by a heating element (not shown) mounted on the substrate 110, for example.

Specific examples of the connection conductor 84 include a metal plate and wiring such as a via or a wire. Specific examples of the heating element 83 include circuit components mounted on the substrate 80 (transistor, IC, etc.).

In FIG. 8, an elongated metal plate that is connected to the outer edge 74 of the ground plane 70 and the outer edge 154 of the plate conductor 150 and an elongated metal plate that is connected to the outer edge 73 of the ground plane 70 and the outer edge 153 of the plate conductor 150 are illustrated as the connection conductors 84.

The radiating element 160 has the feeding portion 165 arranged at a position toward the end portion 163 from the central portion 162, and in this way, the feeding element 20 may be coupled to a high impedance portion of the radiating element 160 through electromagnetic field coupling. Likewise, the radiating elements 170 has the feeding portion 175 arranged at a position toward the end portion 173 from the central portion 172, and in this way, the feeding element 20 may be coupled to a high impedance portion of the radiating element 170 through electromagnetic filed coupling.

In the case where the feeding element 20 is electromagnetically coupled to both the radiating element 160 and the radiating element 170 at high impedance portions and impedance matching with the radiating elements 160 and the radiating element 170 are achieved, the directivity of the antenna 3 may be linearly symmetrical with respect to the YZ plane that passes through the feeding element 20, provided the surrounding environment is uniform.

The impedance control unit 120 is an example of a control unit that controls an impedance variable unit to connect the feeding element 20 to the control element 50 or the control element 60 and vary the impedance between the feeding element 20 and the control element 50 or the impedance between the feeding element 20 and the control element 60. Note that the impedance control unit 120 of FIG. 8 may have a configuration and functions substantially similar to those described above.

Figure 10:
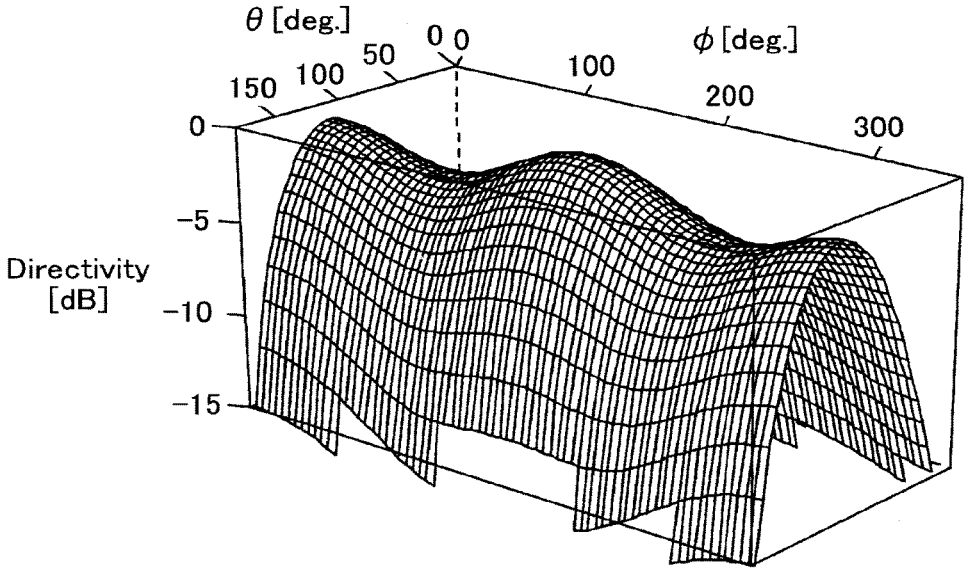
FIG. 10 is a diagram illustrating a directivity of the antenna according to the third embodiment in one exemplary case.
Figure 11:
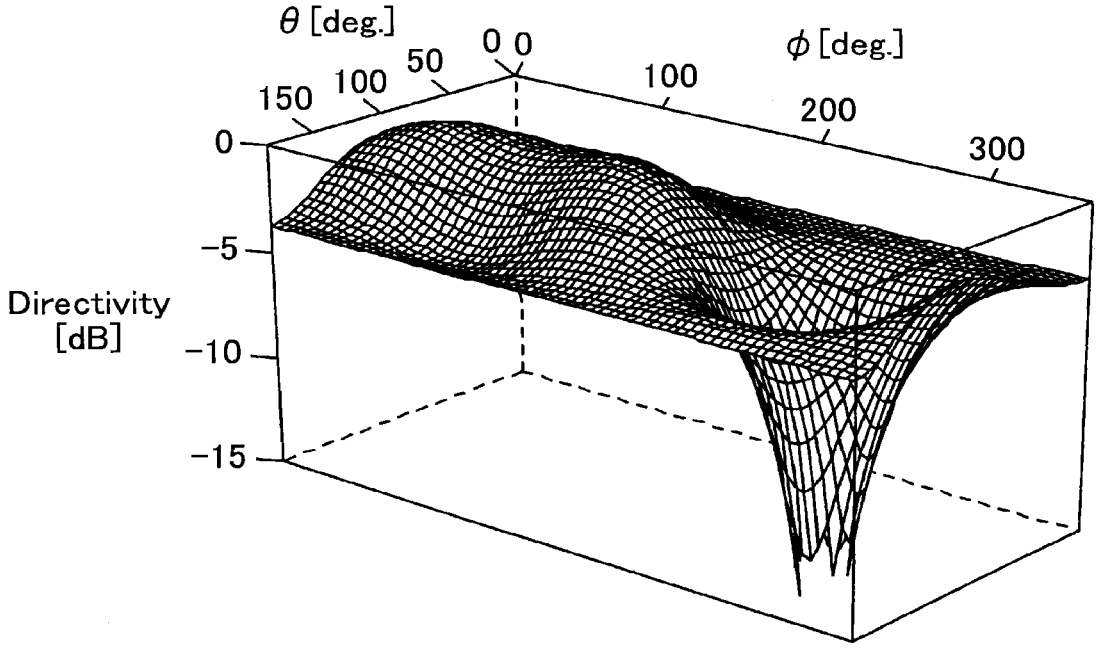
FIG. 11 is a diagram illustrating a directivity of the antenna according to the third embodiment in another exemplary case.

FIGS. 10 and 11 are diagrams illustrating the directivity of the antenna 3. In FIGS. 10 and 11, "directivity" represents the directional gain at the resonant frequency in the fundamental mode of the antenna 3 (1.175 GHz in the present example), θ represents an angle formed with respect to the extending direction of the feeding element 20 within a YZ plane that passes through the feeding portion 11 and a center point of the ground plane 70, and ϕ represents an angle formed with respect to a normal direction of the ground plane 70 within the ZX plane passing through the center point of the ground plane 70 (see FIG. 8).

FIG. 10 illustrates the directivity of the antenna 3 in a case where the impedance between the feeding element 20 and the control element 50 is high, and the impedance between the feeding element 20 and the control element 60 is high. FIG. 11 illustrates the directivity of the antenna 3 in a case where the impedance between the feeding element 20 and the control element 50 is high, and the impedance between the feeding element 20 and the control element 60 is low. As illustrated in FIGS. 10 and 11, the directivity of the antenna 3 may be switched.

The antenna 3 has a symmetrical configuration with respect to an YZ plane that passes through the feeding point 11. Thus, in a case where the impedance between the feeding element 20 and the control element 50 is low, and the impedance between the feeding element 20 and the control element 60 is high, as opposed to the case of FIG. 11, the antenna 3 may have a directivity that is line symmetrical, with respect to ϕ=180°, to the directivity illustrated in FIG. 11.

In FIG. 8, the antenna 3 may include the matching circuit 90 that operates in conjunction with the impedance control unit 120 to adjust the resonant frequency in the fundamental mode of the radiating element 160 and radiating element 170, for example. The matching circuit 90 may be configured to adjust the resonant frequency in conjunction with the operation of the impedance control unit 120 changing the coupling state between the feeding element 20 and the radiating element 160 or the coupling state between the feeding element 20 and the radiating element 170, for example. The matching circuit 90 may be inserted or connected to the feeding element 20, for example.

By using the matching circuit 90, even when the resonant frequency of the fundamental mode of the radiating element 160 or the radiating element 170 is changed as a result of a change in the coupling state between the radiating element 160 and the feeding element 20 or the coupling state between the radiating element 170 and the feeding element 20, the matching circuit 90 may be able to correct such a change in the resonant frequency, for example.

Figure 12:
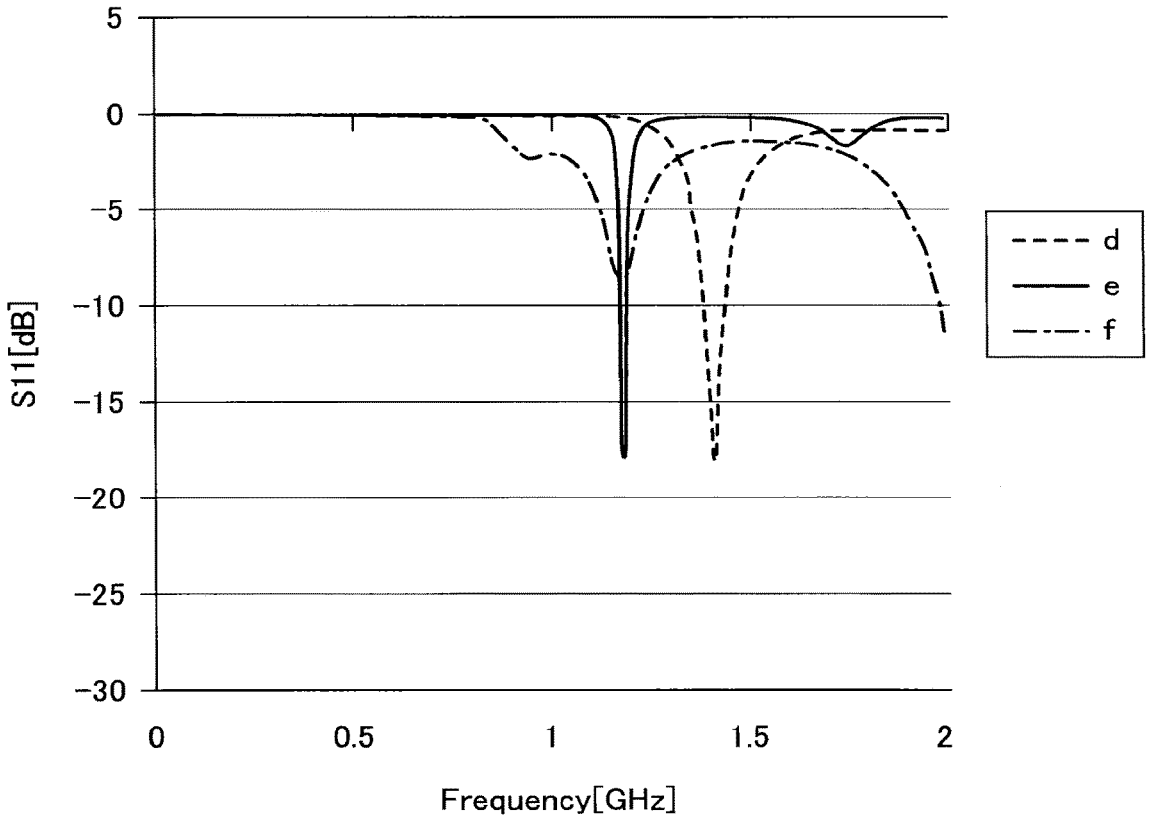
FIG. 12 is a graph indicating S11 measurements for illustrating an effect of a matching circuit of the antenna according to the third embodiment.

FIG. 12 is a graph indicating S11 characteristic measurements of the antenna 3 for illustrating an effect of the matching circuit 90. Note that in FIG. 12, "d" represents a case where the matching circuit 90 is not used, the impedance between the feeding element 20 and the control element 50 is high, and the impedance between the feeding element 20 and the control element 60 is high (impedance adjusting unit 121: high impedance; impedance adjusting unit 122: high impedance). Also, "e" represents a case where the matching circuit 90 is used, the impedance between the feeding element 20 and the control element 50 is high, and the impedance between the feeding element 20 and the control element 60 is high (impedance adjusting unit 121: high impedance; impedance adjusting unit 122: high impedance). Also, "f" illustrates a case where the matching circuit 90 is not used, the impedance between the feeding element 20 and the control element 50 is high, and the impedance between the feeding element 20 and the control element 60 is low (impedance adjusting unit 121: high impedance; impedance adjusting unit 122: low impedance).

FIG. 12 illustrates an example where the matching circuit 90 includes an inductor (inductance: 15 nH) that is serially inserted to the feeding element 20 and an inductor (inductance: 15 nH) inserted between the end portion 21 of the feeding element 20 and the ground plane 70.

In the case where the matching circuit 90 is not operated, when the impedance adjusting unit 122 is switched from ON to OFF, the resonant frequency of the fundamental mode of the radiating element 160 (1.175 GHz in the present example) may deviate in some cases (e.g., change from "f" to "d" in FIG. 12). However, by operating the matching circuit 90 in conjunction with the operation of switching the impedance adjusting unit 122 from ON to OFF, such a deviation of the resonant frequency in the fundamental mode of the radiating element 160 may be prevented (e.g., change from "f" to "e" in FIG. 12).

Note that when measuring the S11 characteristics of the antenna 3, the dimensions of the configuration illustrated in FIG. 8 were set up as follows (in mm).

L11: 120
L12: 80
L13: 60
L14: 10.5
L16: 29.5
L17: 80
L18: 10.5
L19: 26.5
L22: 60

Also, the line widths of the feeding element 20, the radiating elements 160 and 170, the control elements 50 and 60 were set to 1 mm.

Also, the dimensions of the configuration illustrated in FIG. 9 upon measuring the S11 characteristics of the antenna were set up as follows. That is, the substrate 80 was set up to have a relative dielectric constant of $\in_r$=3.3, a loss tangent of tan δ=0.003, and a thickness of H1=0.8 mm; and the substrate 110 was set up to have a relative dielectric constant of $\in_r$=7.44, a loss tangent of tan δ=0.011, and a thickness of H3=1.1 mm. Also, the gap H2 between the substrate 80 and the substrate 110 was set to 2 mm.

<Antenna Device 202>

Figure 13:
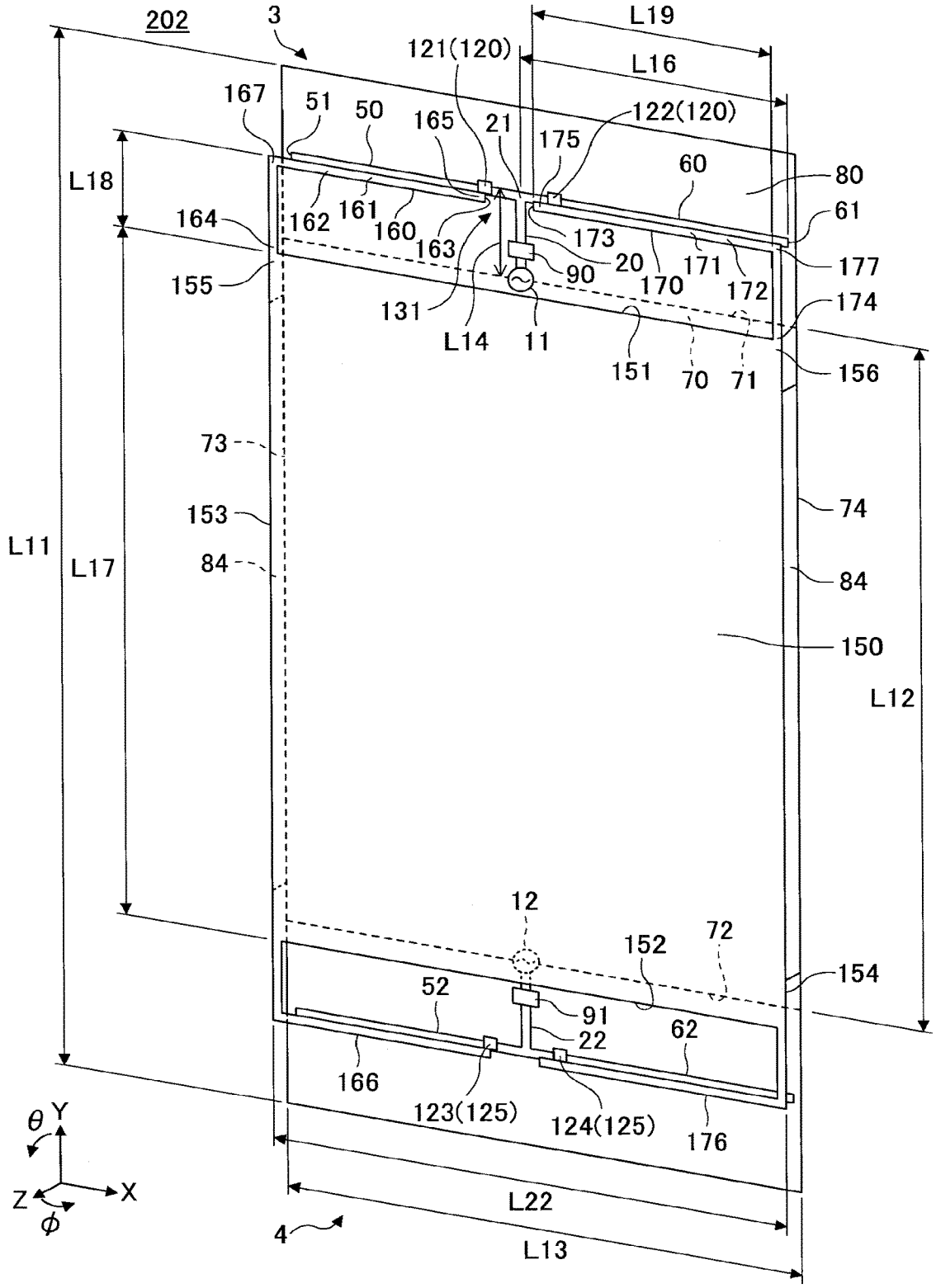
FIG. 13 is a perspective view of an exemplary analysis model of an antenna device including a plurality of antennas according to a fourth embodiment of the present invention.

FIG. 13 is a perspective view of a computer simulation model for analyzing the operation of an antenna device 202 including antennas 3 and 4 according to a fourth embodiment of the present invention. Note that in the present example, CST Microwave Studio (registered trademark) by Computer Simulation Technology AG (CST) was used as an electromagnetic field simulator. Also, note that descriptions of features of the present embodiment that may be substantially identical to those of the embodiments described above may be simplified or omitted.

The antenna 4 may have a configuration that is substantially identical to the configuration of the antenna 3, and is arranged on the opposite side of the antenna 3 with respect to the ground plane 70. The antenna 4 includes a feeding element 22, a radiating element 166, a radiating element 176, a control element 52, a control element 62, an impedance control unit 125, and a matching circuit 91.

The radiating element 166 and the radiating element 176 are each coupled to the feeding element 22 through electromagnetic field coupling. The control element 52 is spaced apart from the radiating element 166 in a direction parallel to the Z-axis, and the control element 62 is spaced apart from the radiating element 176 in a direction parallel to the Z-axis.

By including the antennas 3 and 4, the antenna device 202 can function as a MIMO (Multiple Input Multiple Output) antenna. Also, the antenna device 202 is capable of switching and controlling the directivity of each of the antennas 3 and 4 while maintaining the correlation coefficient between the antenna 3 and the antenna 4 to a desirably low value, regardless of the impedance of the impedance adjusting units 121, 122, 123, and 124.

FIGS. 14-17 are graphs indicating the reflection coefficient S11 of the antenna 3, the reflection coefficient S22 of the antenna 4, the correlation coefficient at the resonant frequency (1.175 GHz in the present example) in the antenna device 202. Note that the correlation coefficient was calculated based on S-parameters. FIGS. 18-25 are graphs indicating the directivity of the antenna device 202. Note that in FIGS. 18-25, "directivity" represents the directional gain at the resonant frequency of the fundamental mode of the antenna device 202 (1.175 GHz in the present example); θ represents an angle formed with respect to the extending direction of the feeding element 20 within a YZ plane that passes through feeding portions 11 and 12, and a center point of the ground plane 70; and ϕ represents an angle formed with respect to a normal direction of the ground plane 70 within the ZX plane passing through the center point of the ground plane 70 (see FIG. 13).

Figure 14:
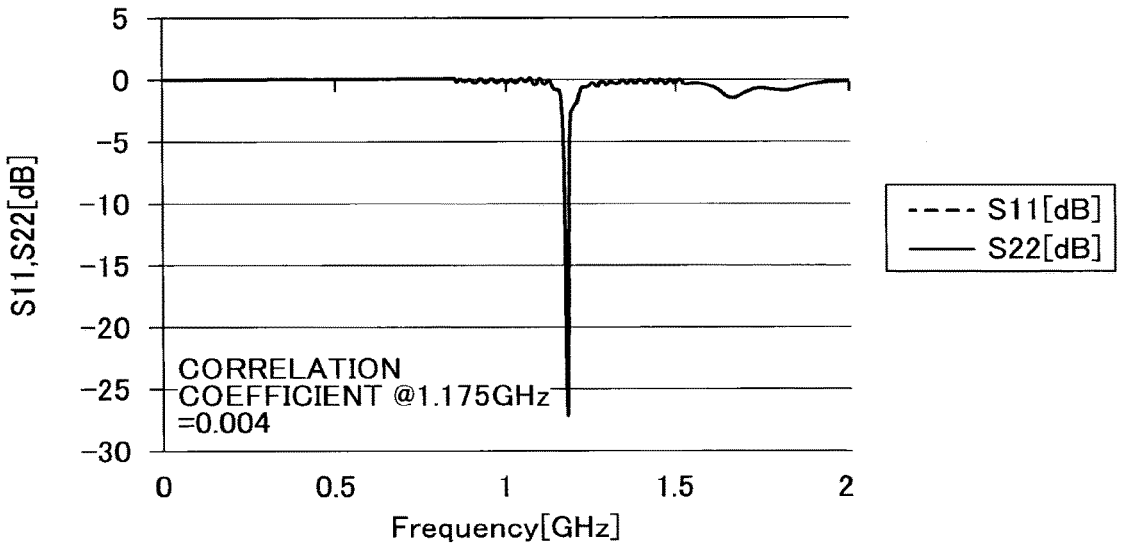
FIG. 14 is a graph indicating S11 and S22 measurements, and a correlation coefficient of the antenna device according to the fourth embodiment in one exemplary case.
Figure 18:
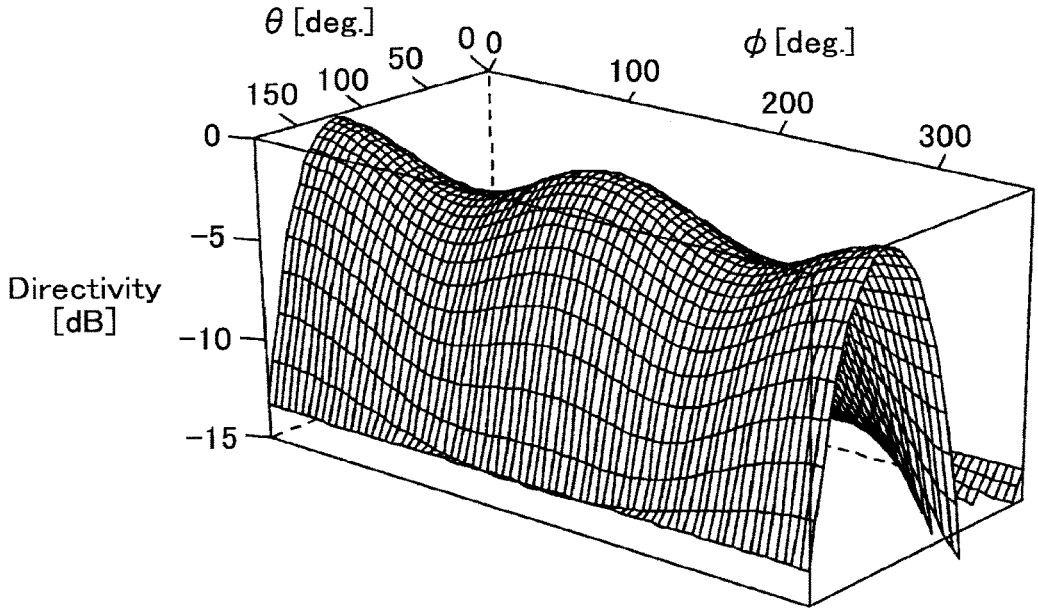
FIG. 18 is a diagram illustrating an exemplary directivity of a first antenna of the antenna device according to the fourth embodiment in one exemplary case.
Figure 19:
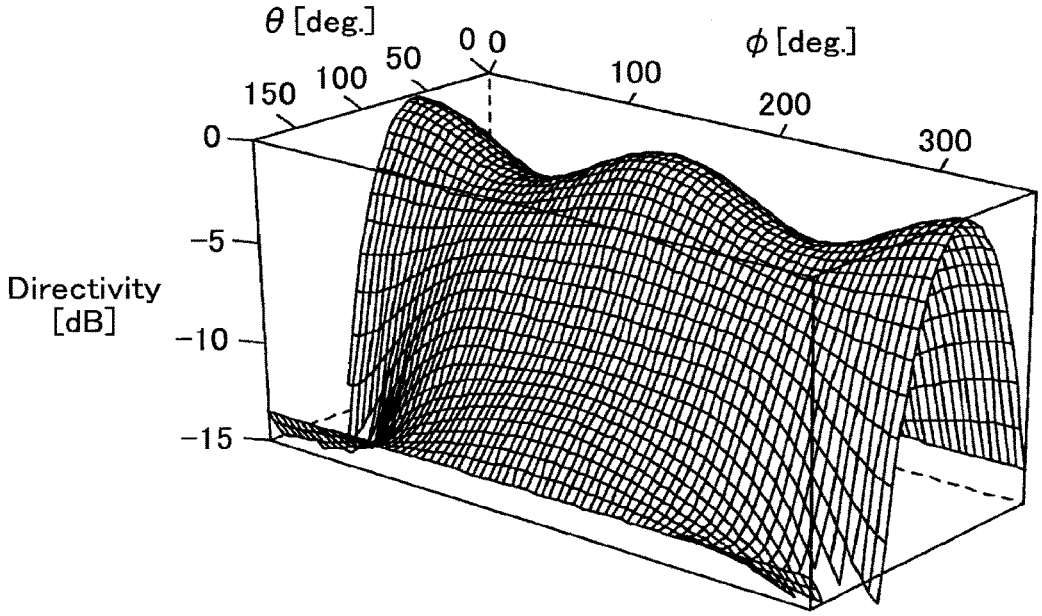
FIG. 19 is a diagram illustrating a directivity of a second antenna of the antenna device according to the fourth embodiment in one exemplary case.

FIGS. 14, 18, and 19 illustrate a case where the impedance between the feeding element 20 and the control element 50 is high, the impedance between the feeding element 20 and the control element 60 is high, the impedance between the feeding element 22 and the control element 52 is high, and the impedance between the feeding element 22 and the control element 62 is high.

Figure 15:
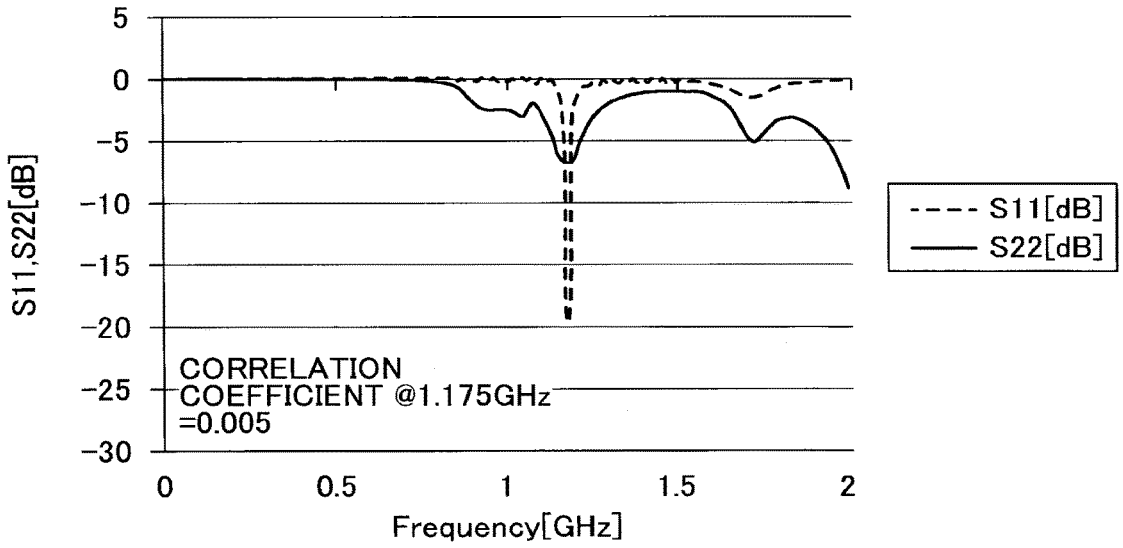
FIG. 15 is a graph indicating S11 and S22 measurements, and a correlation coefficient of the antenna device according to the fourth embodiment in another exemplary case.
Figure 20:
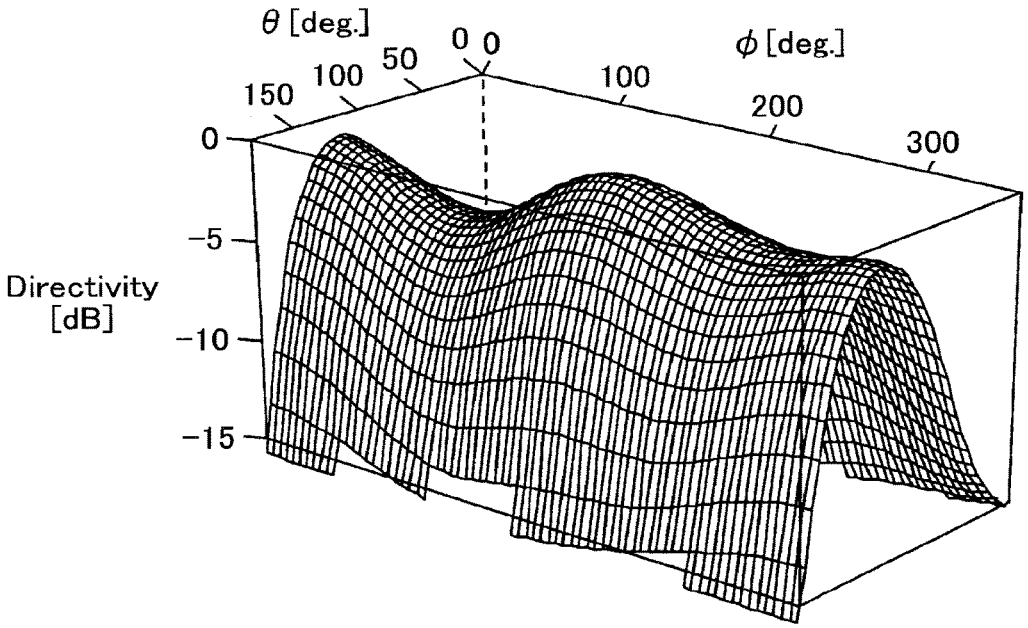
FIG. 20 is a diagram illustrating a directivity of the first antenna of the antenna device according to the fourth embodiment in another exemplary case.
Figure 21:
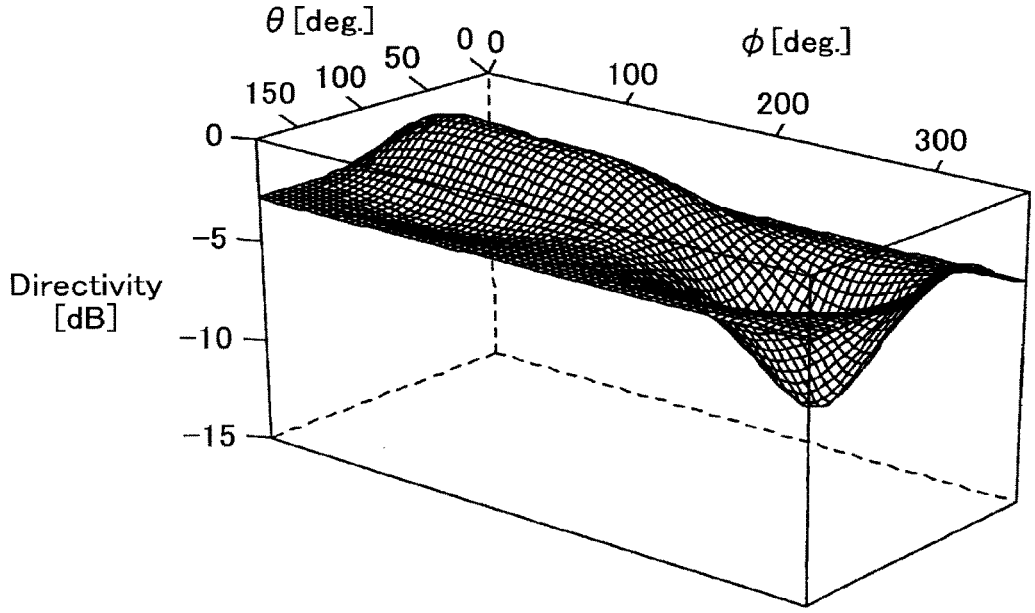
FIG. 21 is a diagram illustrating a directivity of the second antenna of the antenna device according to the fourth embodiment in another exemplary case.

FIGS. 15, 20, and 21 illustrate a case where the impedance between the feeding element 20 and the control element 50 is high, the impedance between the feeding element 20 and the control element 60 is high, the impedance between the feeding element 22 and the control element 52 is high, and the impedance between the feeding element 22 and the control element 62 is low.

Figure 16:
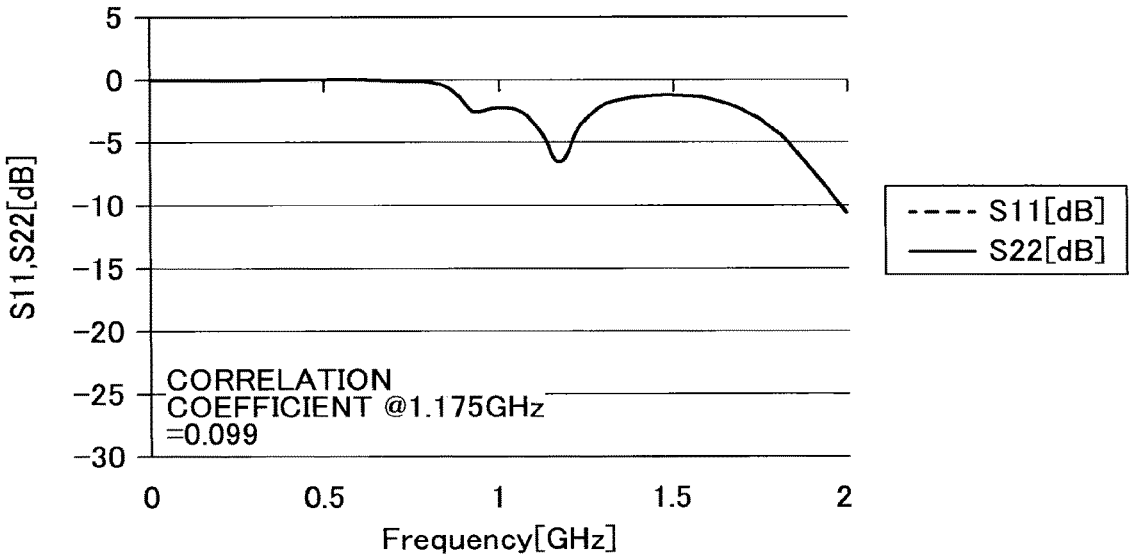
FIG. 16 is a graph indicating S11 and S22 measurements, and a correlation coefficient of the antenna device according to the fourth embodiment in another exemplary case.
Figure 22:
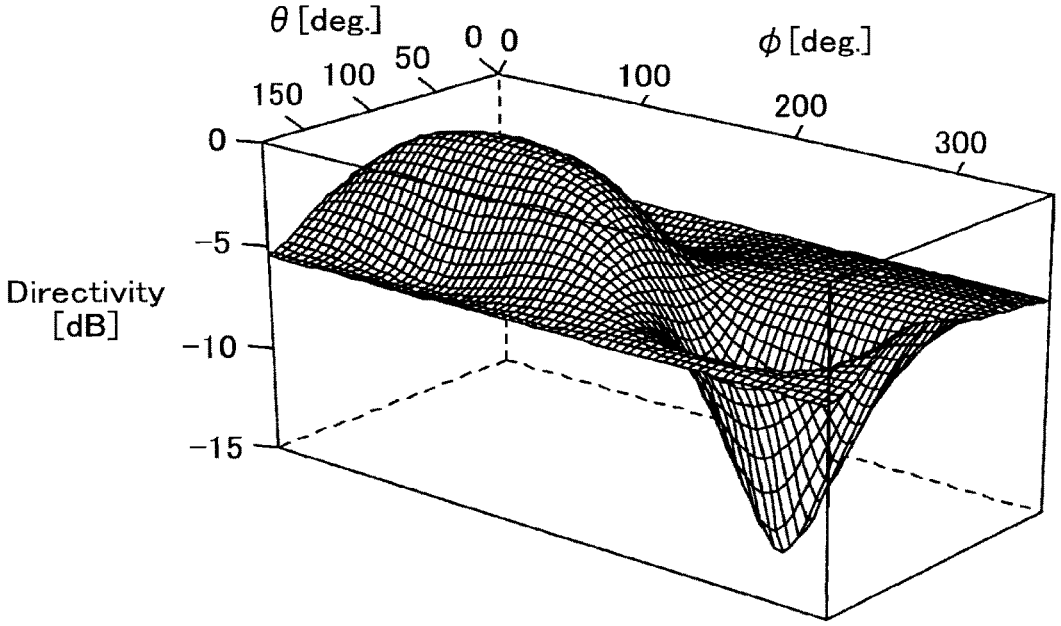
FIG. 22 is a diagram illustrating a directivity of the first antenna of the antenna device according to the fourth embodiment in another exemplary case.
Figure 23:
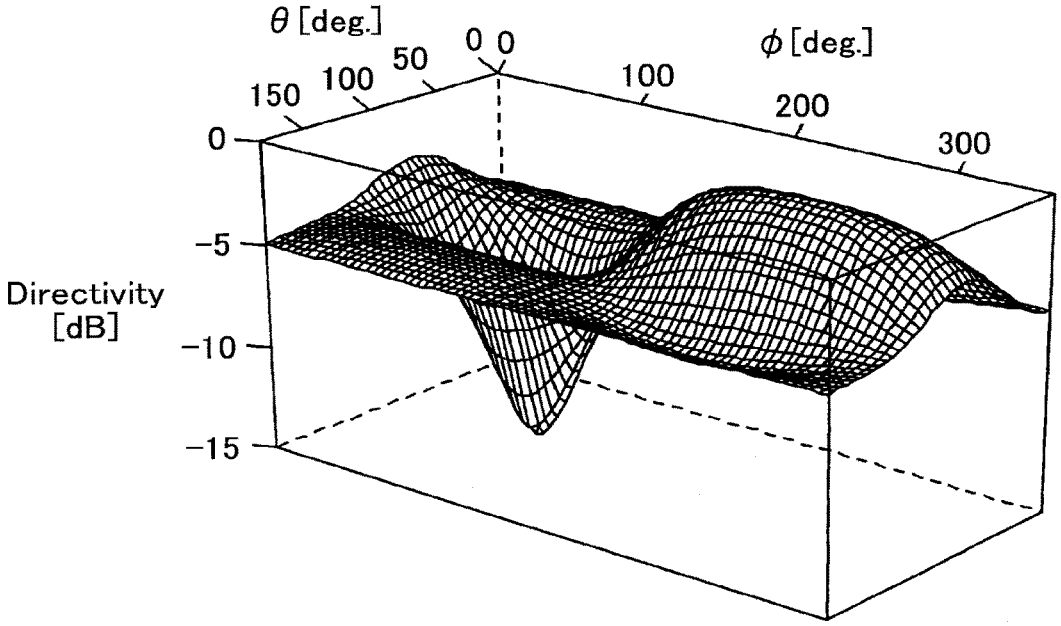
FIG. 23 is a diagram illustrating a directivity of the second antenna of the antenna device according to the fourth embodiment in another exemplary case.

FIGS. 16, 22, and 23 illustrate a case where the impedance between the feeding element 20 and the control element 50 is high, the impedance between the feeding element 20 and the control element 60 is low, the impedance between the feeding element 22 and the control element 52 is low, and the impedance between the feeding element 22 and the control element 62 is high.

Figure 17:
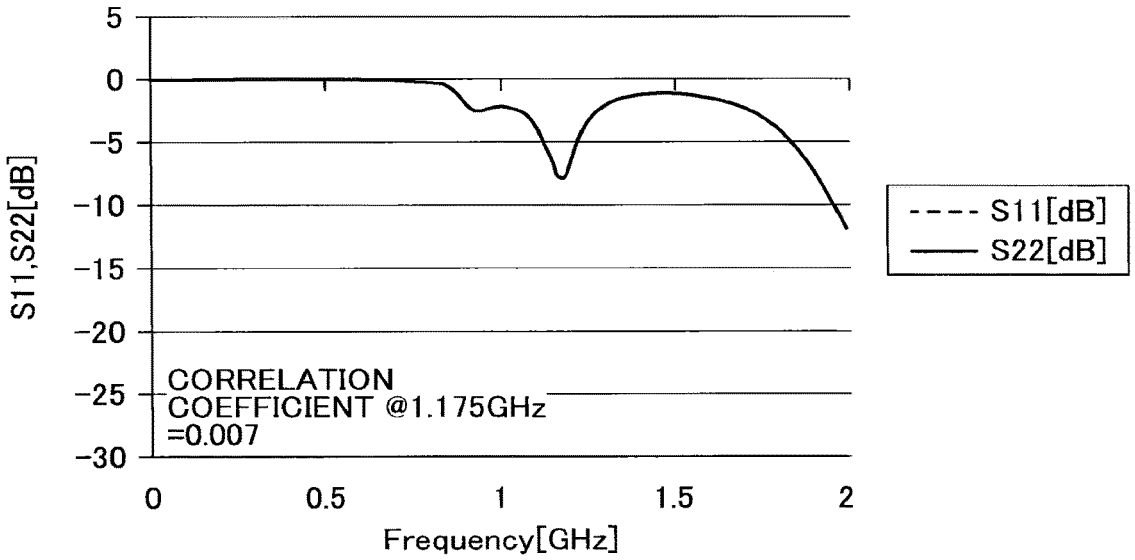
FIG. 17 is a graph indicating S11 and S22 measurements, and a correlation coefficient of the antenna device according to the fourth embodiment in another exemplary case.
Figure 24:
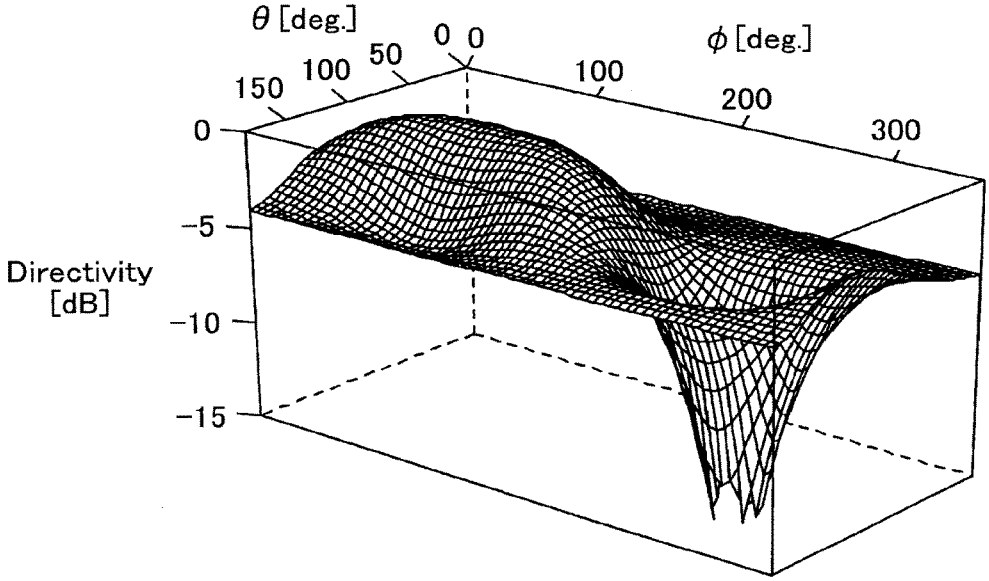
FIG. 24 is a diagram illustrating a directivity of the first antenna of the antenna device according to the fourth embodiment in another exemplary case.
Figure 25:
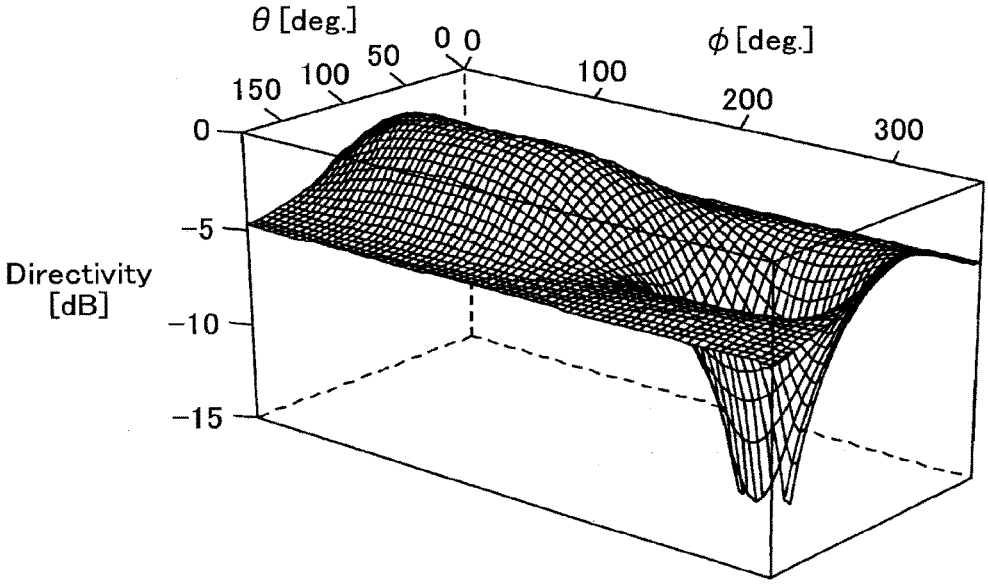
FIG. 25 is a diagram illustrating a directivity of the second antenna of the antenna device according to the fourth embodiment in another exemplary case.

FIGS. 17, 24, and 25 illustrate a case where the impedance between the feeding element 20 and the control element 50 is high, the impedance between the feeding element 20 and the control element 60 is low, the impedance between the feeding element 22 and the control element 52 is high, and the impedance between the feeding element 22 and the control element 62 is low.

In FIGS. 14, 16, and 17, the S11 measurements and the S22 measurements substantially overlap. The correlation coefficients in the cases of FIGS. 14 to 17 are respectively 0.004, 0.005, 0.099, and 0.007. These correlation coefficient values all adequately satisfy the requirements of a MIMO antenna relating to the correlation between S11 and S22 characteristics. Also, note that FIGS. 18, 20, 22, and 24 represent the directivity of the antenna 3; and FIGS. 19, 21, 23, and 25 represent the directivity of the antenna 4. As can be appreciated from these drawings, even when the antenna 3 and the antenna 4 share the same ground plane 70, the directivity of the antenna 3 and the antenna 4 may be switched and controlled while maintaining the correlation coefficient between the antenna 3 and the antenna 4 to a desirably low value.

Note that the dimensions of the configurations illustrated in FIGS. 13 and 9 upon measuring the S11 and S22 characteristics of the antenna device 202 were the same as the above dimensions that were used in measuring the S11 characteristics of the antenna 3 of FIG. 8.

<Antenna 5>

Figure 26:
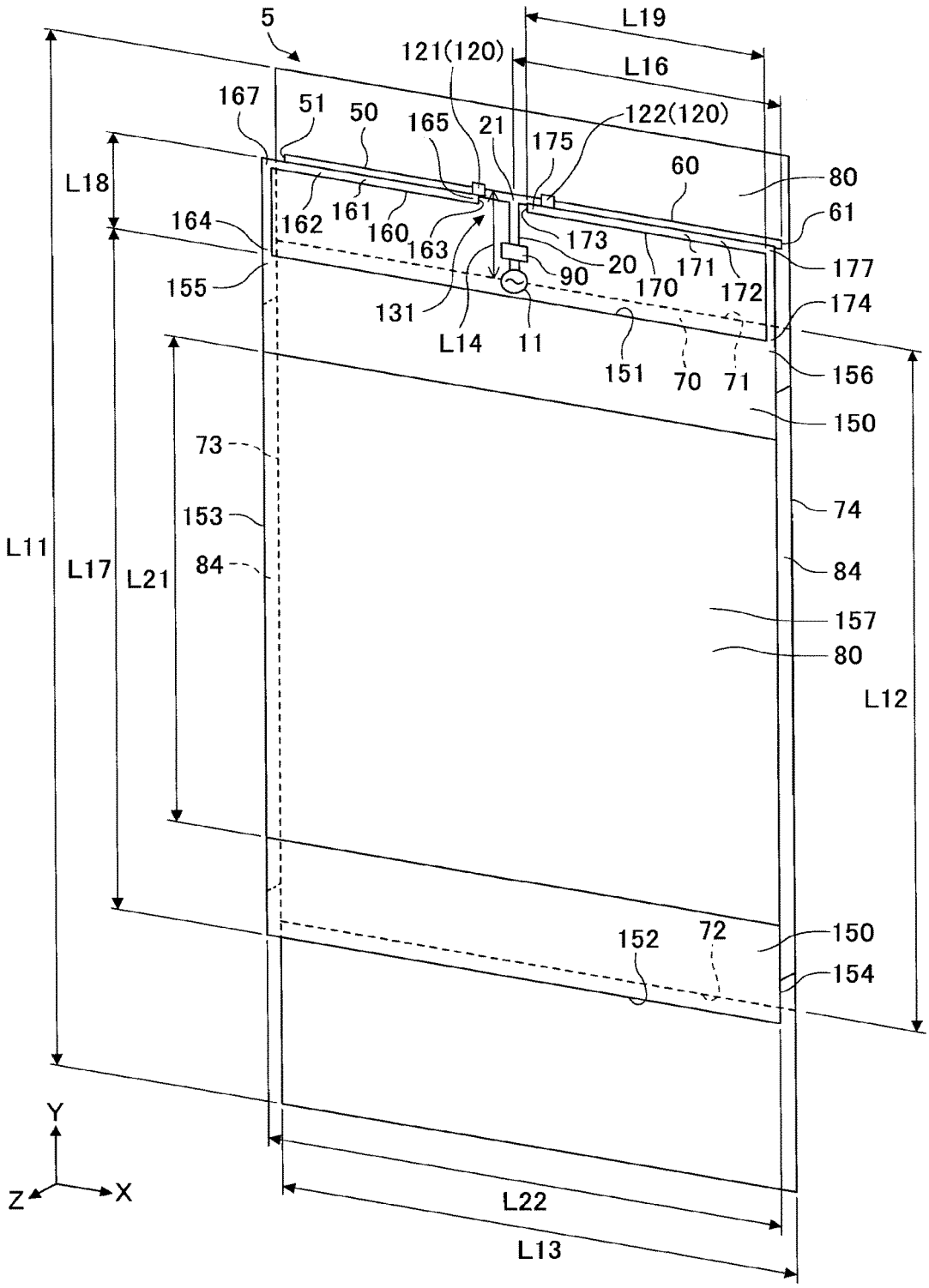
FIG. 26 is a perspective view of an exemplary analysis model of an antenna according to a fifth embodiment of the present invention.

FIG. 26 is a perspective view of a computer simulation model for analyzing the operation of an antenna 5 according to a fifth embodiment of the present invention. Note that in the present example, CST Microwave Studio (registered trademark) by Computer Simulation Technology AG (CST) was used as an electromagnetic field simulator. Also, note that descriptions of features of the present embodiment that may be substantially identical to those of the embodiments described above may be simplified or omitted.

The antenna 5 corresponds to a modification of the antenna 3 that is obtained by cutting out the plate conductor 150 of the antenna illustrated in FIG. 8 to form an opening 157. In the antenna 5, the substrate 80 is visible through the opening 157 in plan view from a direction parallel to the Z-axis. By providing the opening 157 in the plate conductor 150, the height tolerance for components mounted on the substrate 80 may be increased such that other antennas and components such as IC tags may be mounted, for example.

Figure 27:
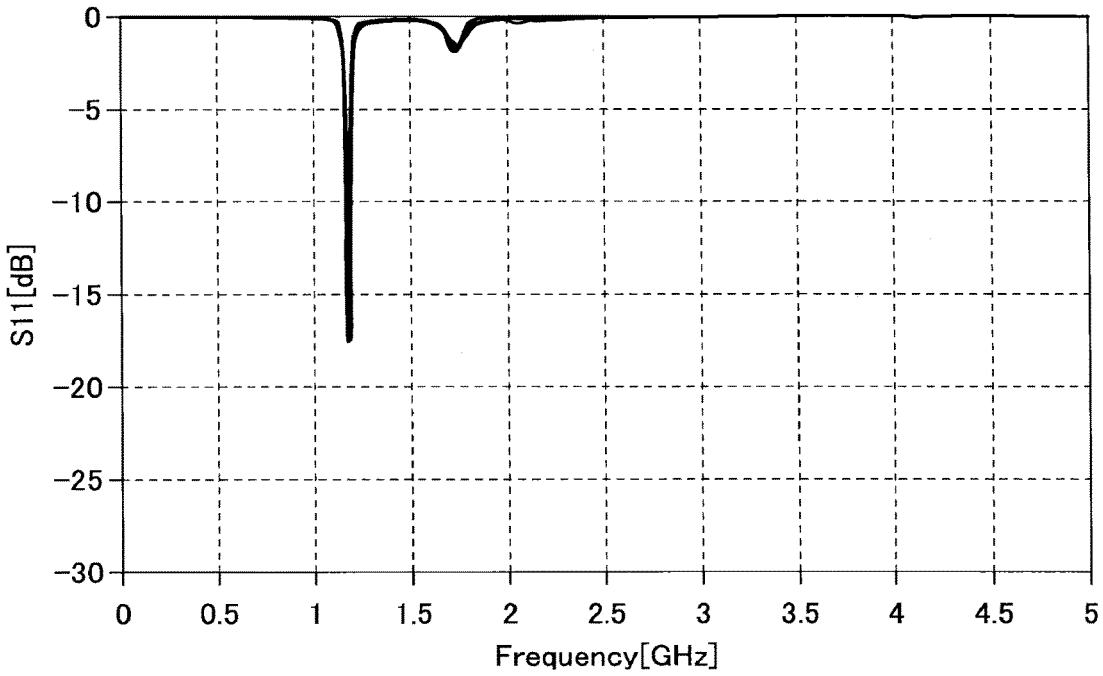
FIG. 27 is a graph indicating S11 measurements of the antenna according to the fifth embodiment.

FIG. 27 is a graph indicating S11 characteristic measurements of the antenna 5 in four cases where the dimension L21 (see FIG. 26) of the opening 157 is, 0 mm, 20 mm, 40 mm, and 60 mm. Note that "L21=0 mm" corresponds to a case where the opening 157 is not provided. In FIG. 27, the S11 characteristic measurements obtained in the four cases substantially overlap. As can be appreciated from FIG. 27, even when the opening 157 is formed in the plate conductor 150, no substantial changes occur in the resonant frequency, and the antenna 5 may be suitably operated.

<Antenna 6>

Figure 28:
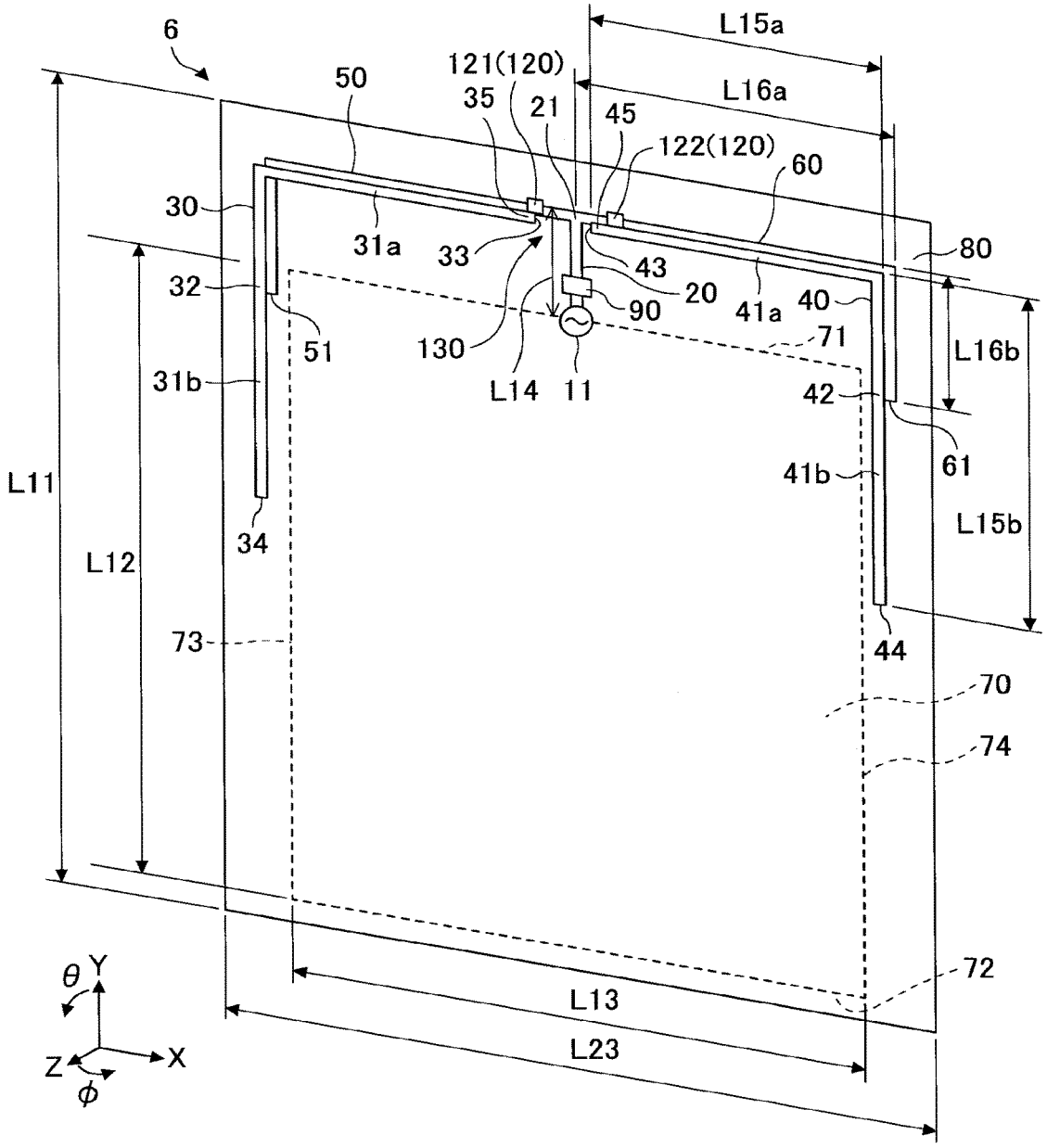
FIG. 28 is a perspective view of an exemplary analysis model of an antenna according to a sixth embodiment of the present invention.

FIG. 28 is a perspective view of an antenna 6 according to a sixth embodiment of the present invention. Note that descriptions of features of the present embodiment that may be substantially identical to those of the embodiments described above may be omitted or simplified.

The antenna 6 has the same components as those of the antenna 1 of FIG. 1, and the positional relationship between the components of the antenna 6 may be substantially identical to the positional relationship between the components of the antenna 1. The antenna 6 includes L-shaped radiating elements 30 and 40 that are arranged along the outer edge of the ground plane 70, and L-shaped control elements 50 and 60 that are arranged along the outer edge of the ground plane 70. The antenna 6 has a symmetrical configuration with respect to the YZ plane.

The radiating element 30 includes a conductive portion extending along the outer edge 71, and a conductive portion extending along the outer edge 73. The radiating element 40 includes a conductive portion extending along the outer edge 71, and a conductive portion extending along the outer edge 74. The ground plane 70 includes the outer edge 73 and outer edge 74 that oppose each other.

By arranging the radiating element 30 and the radiating element 40 such that the ground plane 70 may be interposed between the conductive portion of the radiating element 30 and the conductor portion of the radiating element 40, directivity control of the antenna 6 may be facilitated. For example, by arranging the radiating element 30 to include a conductive portion that extends along the outer edge 73, and by arranging the radiating element 40 to include a conductor portion that extends along the outer edge 74 opposing the outer edge 73, the directivity control of the antenna 6 may be facilitated.

Figure 29:
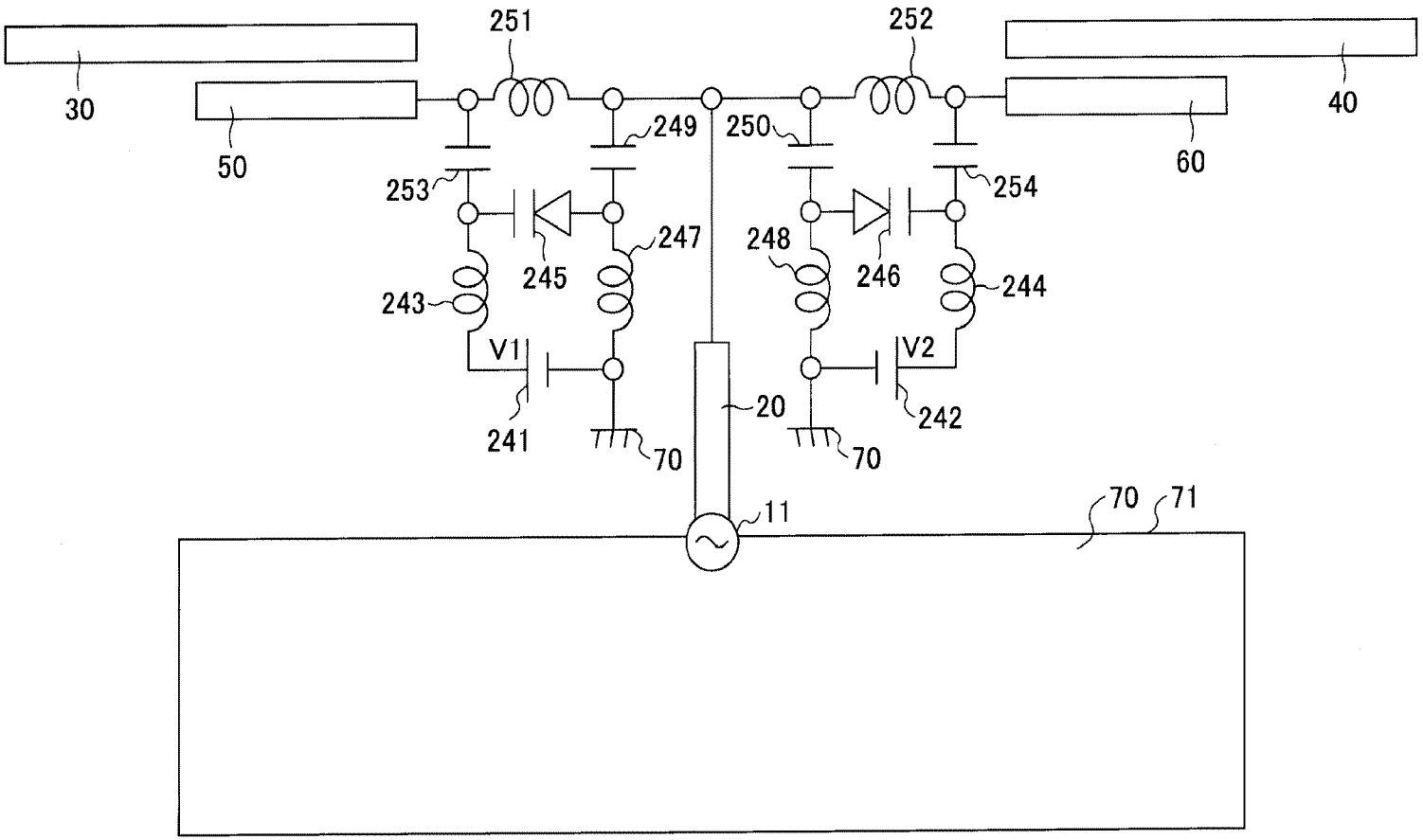
FIG. 29 is a diagram illustrating an exemplary configuration of an impedance control unit of the antenna according to the sixth embodiment.

FIG. 29 illustrates an exemplary configuration of the impedance control unit 120. In FIG. 29, the impedance control unit 120 includes inductors 243, 244, 247, 248, 251, and 252, capacitors 249, 250, 253, and 254, variable capacitance diodes 245 and 246, and DC voltage sources 241 and 242.

One end of the inductor 251 is connected to one end of the control element 50, and the other end of the inductor 251 is connected to the end portion 21 of the feeding element 20. A series circuit including the capacitor 253 and the inductor 243 is connected between the positive terminal of the DC voltage source 241 and a connection point between the inductor 251 and the control element 50. A series circuit including the capacitor 249 and the inductor 247 is connected to a negative terminal of the DC voltage source 241 and a connection point between the inductor 251 and the feeding element 20. The negative terminal of the DC voltage source 241 is connected to the ground plane 70. The variable capacitance diode 245 includes a cathode that is connected to a connection point between the capacitor 253 and the inductor 243, and an anode that is connected to a connection point between the capacitor 249 and the inductor 247.

One end of the inductor 252 is connected to one end of the control element 60, and the other end of the inductor 252 is connected to the end portion 21 of the feeding element 20. A series circuit including the capacitor 254 and the inductor 244 is connected to a positive terminal of the DC voltage source 242 and a connection point between the inductor 252 and the control element 60. A series circuit including the capacitor 250 and the inductor 248 is connected to the negative terminal of the DC voltage source 242 and a connection point between the inductor 252 and the feeding element 20. The negative terminal of the DC voltage source 242 is connected to the ground plane 70. The variable capacitance diode 246 includes a cathode that is connected to a connection point between the capacitor 254 and the inductor 244, and an anode that is connected to a connection point between the capacitor 250 and the inductor 248.

When the DC voltage source 241 controls the output of a DC voltage V1, adjusts the capacitance of the variable capacitance diode 245, and increases the impedance between the feeding element 20 and the control element 50, an RF current flowing through the control element 50 may be suppressed or stopped. In this way, the connection between the feeding element 20 and the control element 50 may be weakened or disconnected such that the radiating element 30 that is electromagnetically coupled to the feeding element 20 may be able to implement its function as a radiating conductor.

Conversely, when the DC voltage source 241 controls the output of the DC voltage V1, adjusts the capacitance of the variable capacitance diode 245, and decreases the impedance between the feeding element 20 and the control element 50, the RF current flowing though the control element 50 may be increased. In this way, the connection between the feeding element 20 and the control element 50 may be strengthened such that the function of the radiating element 30, which is electromagnetically coupled to the feeding element 20, as a radiating conductor may be suppressed or stopped.

Similarly, when the DC voltage source 242 controls the output of a DC voltage V2, adjusts the capacitance of the variable capacitance diode 246, an increases the impedance between the feeding element 20 and the control elements 60, the RF current flowing through the control element 60 may be suppressed or stopped. In this way, the connection between the feeding element 20 and the control element 60 may be weakened or disconnected such that the radiating element 40 that is electromagnetically coupled to the feeding element 20 may implement its function as a radiating conductor.

Conversely, when the DC voltage source 242 controls the output of the DC voltage V2, adjusts the capacitance of the variable capacitance diode 246, and decreases the impedance between the feeding element 20 and the control element 60, the RF current flowing through the control element 60 may be increased. In this way, the connection between the feeding element 20 and the control element 60 may be strengthened such that the function of the radiating element 40, which is electromagnetically coupled to the feeding element 20, as a radiating conductor may be suppressed or stopped.

By using the impedance control unit 120 as illustrated in FIG. 29, the impedance between the feeding element 20 and the control element 50 and the impedance between the feeding element 20 and the control element 60 may be gradually changed (decreased or increased). By gradually changing the impedance, the directivity of the antenna may also be gradually changed according to the surrounding environment rather than being switched on/off, for example.

Figure 30:
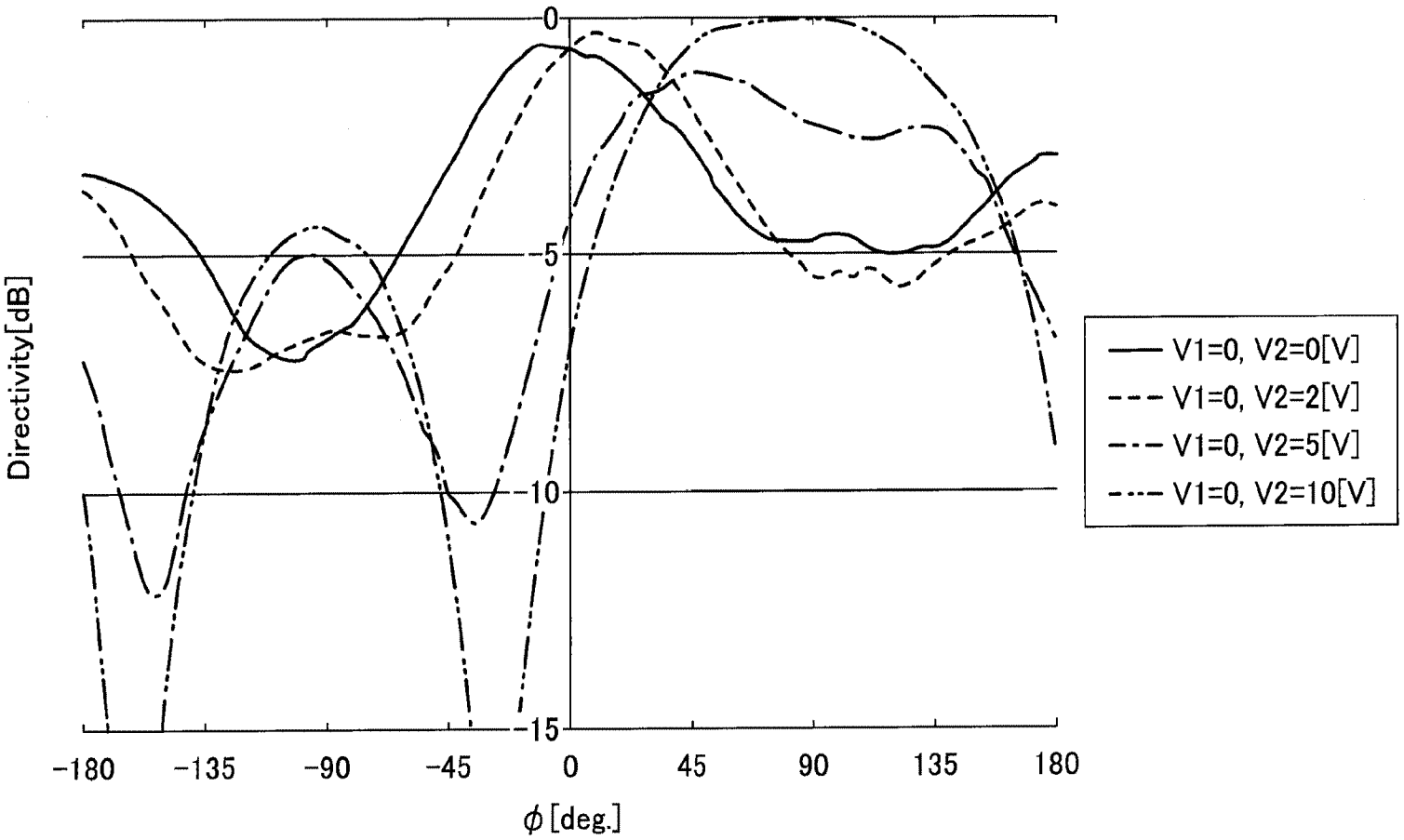
FIG. 30 is a graph illustrating a continuous change in directivity.

FIG. 30 is graph illustrating an exemplary case where the directivity of the antenna 6 is continuously changed by the impedance control unit 120 as illustrated in FIG. 29. Note that in FIG. 30, "directivity" represents the directional gain at the resonant frequency of the fundamental mode of the antenna 6 (1.91 GHz in the present example), and $\phi$ represents an angle formed with respect to a normal direction of the ground plane 70 within the ZX plane passing through the center point of the ground plane 70 (see FIG. 28). Note that the directivity when $\phi=0°$ represents the antenna gain of the antenna 6 in the Z-axis direction.

As illustrated in FIG. 30, provided the DC voltage V1 of the DC voltage source 241 is fixed to a predetermined value (zero in the present example), as the DC voltage V2 of the DC voltage source 242 increases, the angle $\phi$ at which the directional gain reaches its peak value continuously changes from an angle close to 0° to 90°. Although not illustrated in FIG. 30, in the converse case where the DC voltage V2 of the DC voltage source 242 is fixed to a predetermined value (e.g., zero), as the DC voltage V1 of the DC voltage source 241 increases, the angle $\phi$ at which the directional gain reaches its peak value continuously changes from an angle close to 0° to −90°. In this way, the impedance control unit 120 is capable of continuously changing the directivity of the antenna 6.

Note that in measuring the directivity of the antenna 6 in FIG. 30, the dimensions of the configuration illustrated in FIG. 28 were set up as follows (in mm).

L11: 120
L12: 68.2
L13: 38.75
L14: 8.525
L15*a*: 21.475
L15*b*: 34.1
L16*a*: 23.675
L16*b*: 8.525
L23: 60

Also, the line widths of the feeding element 20, the radiating elements 30 and 40, and the control elements 50 and 60 were set to 1 mm.

Also, in obtaining the measurements of FIG. 30, the dimensions of the configuration illustrated in FIG. 2 were set up as follows. That is, the substrate 80 was set up to have a relative dielectric constant of $\in_r=3.3$, a loss tangent of tan $\delta=0.003$, and a thickness of H1=0.8 mm; and the substrate 110 was set up to have a relative dielectric constant of $\in_r=7.44$, a loss tangent of tan $\delta=0.011$, and a thickness of H3=1.1 mm. Also, the gap H2 between the substrate 80 and the substrate 110 was set to 2 mm.

Also, in obtaining the measurements of FIG. 30 the component illustrated in FIG. 29 were set up as follows. That is, the inductance of the inductors 251 and 252 were set to 1.5 nH, the inductance of the inductors 243, 244, 247, and 248 were set to 15 nH, the capacitance of the capacitors 249, 250, 253, and 254 were set to 2.2 pF.

<Antenna Device 203>

Figure 31:
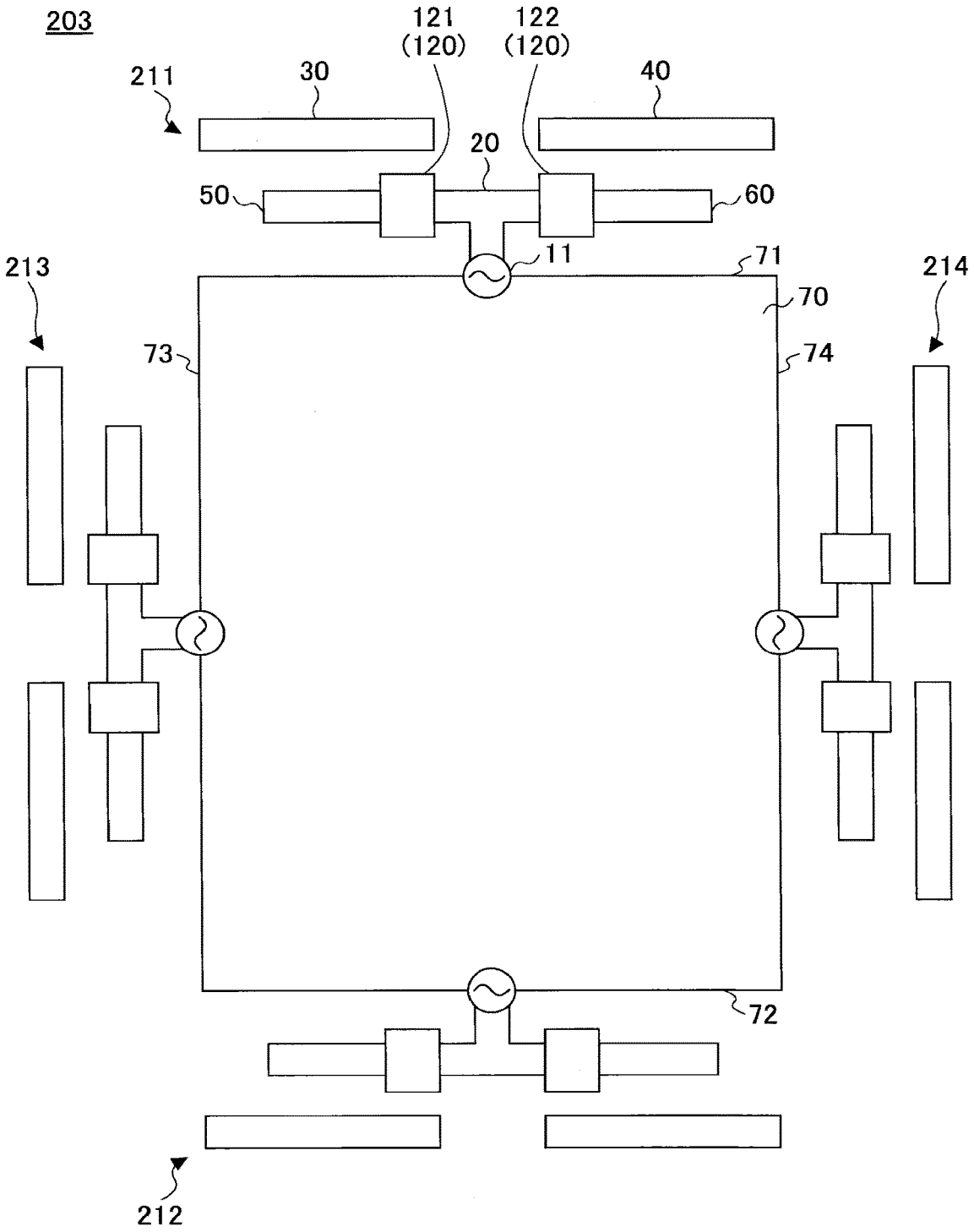
FIG. 31 is a plan view schematically illustrating an antenna device according to a seventh embodiment of the present invention.

FIG. 31 is a plan view of an antenna device 203 including four antennas 211, 212, 213 and 214 that have the same configuration as the antenna 1 of FIG. 1. The antenna 211 includes radiating elements having conductor portions arranged along the outer edge 71 of the ground plane 70. The antenna 212 includes radiating elements having conductor portions arranged along the outer edge 72 opposing the outer edge 71. The antenna 213 includes radiating elements having conductor portions arranged along the outer edge 73. The antenna 214 includes radiating elements having conductor portions arranged along the outer edge 74 opposing the outer edge 73.

By including the antennas 211, 212, 213, and 214 in the antenna device 203, the antenna device 203 may function as a four-channel MIMO (Multiple Input Multiple Output) antenna. Also, even when the antennas of the antenna device 203 share the same ground plane 70, the antenna device 203 may be capable of switching and controlling the directivity of each of the antennas while maintaining the correlation coefficients between the antennas to desirably low values, regardless of the impedance of the impedance adjusting units 121 and 122 of the antennas.

Figure 32:
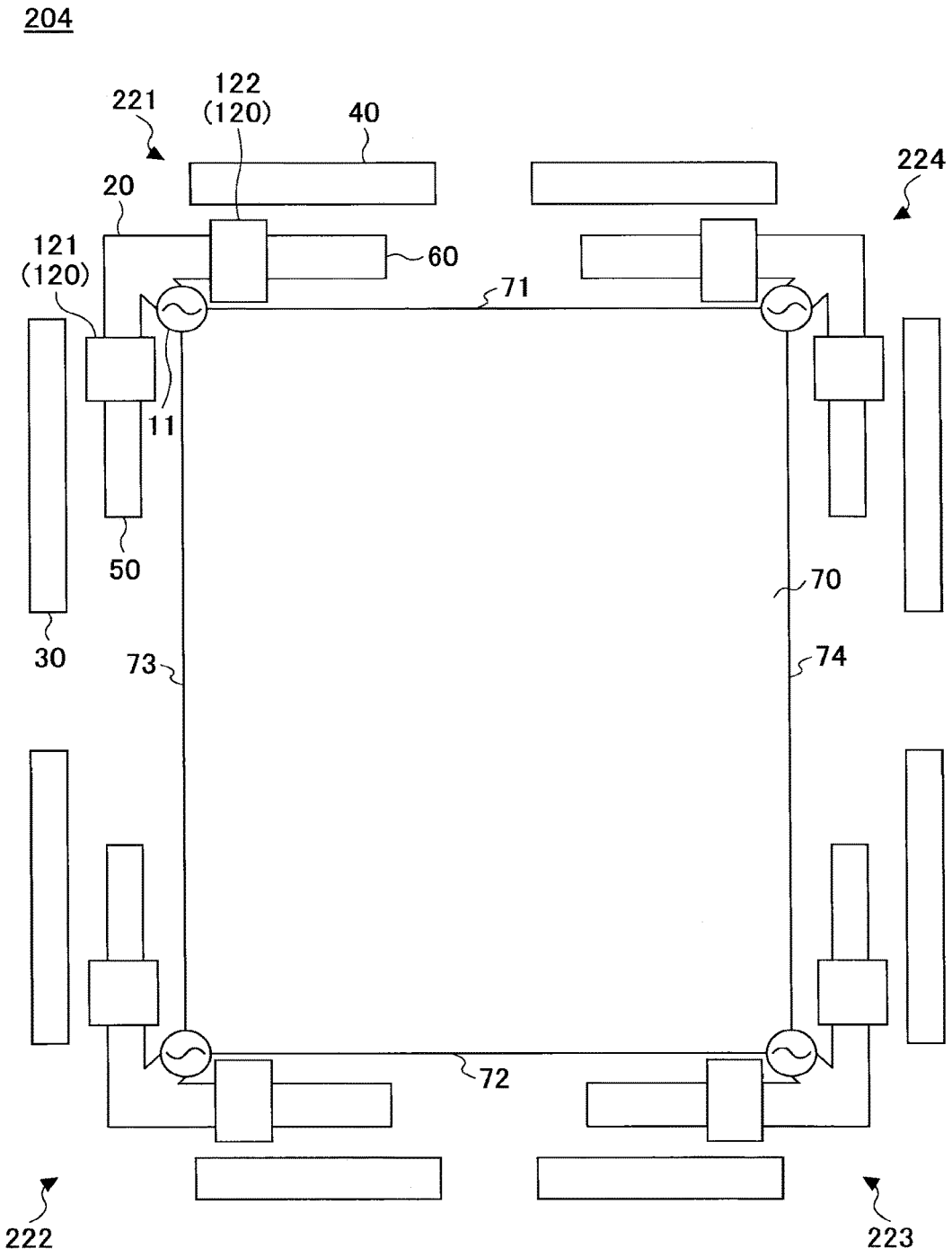
FIG. 32 is a plan view schematically illustrating an antenna device according to an eighth embodiment of the present invention.

FIG. 32 is a plan view of an antenna device 204 including four antennas 221, 222, 223, and 224 having configurations similar to that of the antenna 1 of FIG. 1. The antenna 221 includes radiating elements having conductor portions arranged along the outer edges 71 and 73. The antenna 222 includes radiating elements having conductor portions arranged along the outer edges s 72 and 73. The antenna 223 includes radiating elements having conductor portions arranged along the outer edges 72 and 74. The antenna 224 includes radiating elements having conductor portions arranged along the outer edges 71 and 74.

The antenna device 204 may also function as a four-channel MIMO (Multiple Input Multiple Output) antenna in a manner similar to the antenna device 203 of FIG. 31. The antenna device 204 may also be capable of switching and controlling the directivity of each of the antennas while maintaining the correlation coefficients between the antennas to desirably low values.

Although an antenna, an antenna device, and a wireless device according to the present invention have been described above with respect to certain illustrative embodiments, the present invention is not limited to these embodiments and various modifications and improvements may be made without departing from the scope of the present invention.

For example, the configuration of the antenna is not limited to the specific embodiments described above. For example, the antenna may include a conductor portion that is directly connected to a radiating element or indirectly connected to the radiating element via a connection conductor. Also, the antenna may include a conductor portion that is coupled to a radiating element through high-frequency (e.g., capacitive) coupling.

Also, the feeding element, the radiating element, and the control element are not limited to linear conductors extending linearly but may include a curved conductor portion. For example, the feeding element, the radiating element, and/or the control element may include an L-shaped conductor portion, a meander-shaped conductor portion, or a conductor portion with branches spreading out from an intermediate point.

Also, the transmission line including the ground plane is not limited to a microstrip line. For example, a strip line or a coplanar waveguide with a ground plane (coplanar waveguide with a ground plane arranged on a surface on the opposite side of a conductor surface) may be used.

Also, the outer profile of the ground plane is not limited those illustrated in the drawings. That is, the ground plane may be a conductive pattern having other outer profiles. Also, the ground plane is not limited to a planar shape and may alternatively be arranged into a curved shape, for example. Similarly, the outer profile of the plate conductor is not limited to those illustrated in the drawings but it may be a conductor having other outer profiles. Also, the plate conductor is not limited to a planar shape and may alternatively be arranged into a curved shape.

Also, note that the term "plate" used above in describing the configuration of a conductor and the like may also encompass configurations arranged into a "foil" or a "film", for example.

Also, note that by arranging the lengths of the radiating elements (e.g., radiating elements 30 and 40 in the case of FIG. 1) running parallel to the outer edge of the ground plane to be equal to each other, the directivity control of the antenna may be facilitated.

Also, by controlling the directivity of the antennas provided in an antenna device to be directed in the same direction, the antenna device may function as a diversity antenna.

What is claimed is:

1. An antenna, comprising:

a feeding element connected to a feeding point;

a first radiating element spaced apart from the feeding element by a distance set such that the first radiating element is coupled to the feeding element through electromagnetic field coupling and establishes noncontact feeding via the feeding element;

a second radiating element spaced apart from the feeding element by a distance set such that the second radiating element is coupled to the feeding element through electromagnetic field coupling and establishes noncontact feeding via the feeding element;

a first control element connected to the feeding element via a first impedance variable unit and positioned such that when the first impedance variable unit decreases an impedance at a resonant frequency of the first radiating element, the electromagnetic field coupling between the feeding element and the first radiating element is weakened and a radiating conductor function of the first radiating element is degraded; and a second control element connected to the feeding element via a second impedance variable unit and positioned such that when the second impedance variable unit decreases an impedance at a resonant frequency of the second radiating element, the electromagnetic field coupling between the feeding element and the second radiating element is weakened and a radiating conductor function of the second radiating element is degraded, wherein the first impedance variable unit comprises circuitry configured to adjust connection between the feeding element and the first control element, the second impedance variable unit comprises circuitry configured to adjust connection between the feeding element and the second control element, in a dipole mode, a feeding portion of each of the first radiating element and the second radiating element at which the feeding element feeds the first radiating element or the second radiating element is located at a first region spaced apart from a lowest impedance portion of the first radiating element or the second radiating element by a distance greater than or equal to ⅛ of a total length of the first radiating element or the second radiating element; in a monopole mode, the feeding portion is located at a second region spaced apart from the lowest impedance portion of the first radiating element or the second radiating element by a distance greater than or equal to ¼ of the total length of the first radiating element or the second radiating element; and in a loop mode, the feeding portion is located at a third region spaced apart from a highest impedance portion of the first radiating element or the second radiating element by a distance less than or equal to 3/16 of an inner circumference of a loop formed by the first radiating element or the second radiating element.

2. The antenna according to claim 1, wherein the first control element is positioned such that when the first impedance variable unit reduces the impedance between the first control element and the feeding element at the resonant frequency of the first radiating element to a low impedance, the electromagnetic field coupling between the feeding element and the first radiating element is weakened and the radiating conductor function of the first radiating element ceases; and the second control element is positioned such that when the second impedance variable unit reduces the impedance between the second control element and the feeding element at the resonant frequency of the second radiating element to a low impedance, the electromagnetic field coupling between the feeding element and the second radiating element is weakened and the radiating conductor function of the second radiating element ceases.

3. The antenna according to claim 1, wherein the circuitry of the first impedance variable unit is configured to degrade the radiating conductor function of the first radiating element by lowering the impedance between the feeding element and the first control element, and the circuitry of the second impedance variable unit is configured to degrade the radiating conductor function of the second radiating element by lowering the impedance between the feeding element and the second control element.

4. The antenna according to claim 1, wherein the first radiating element and the second radiating element are positioned such that the feeding element extends from the feeding point toward a gap formed between the first radiating element and the second radiating element.

5. The antenna according to claim 1, wherein the first radiating element or the second radiating element satisfy that Le20 is less than or equal to (3/8)λ, that when a fundamental mode of resonance of the first radiating element or the second radiating element corresponds to a dipole mode, Le30 and Le40 are greater than or equal to (3/8)λ and less than or equal to (5/8)λ, that when the fundamental mode of resonance of the first radiating element or the second radiating element corresponds to a loop mode, Le30 and Le40 is greater than or equal to (7/8)λ, and less than or equal to (9/8)λ, and that when the fundamental mode of resonance of the first radiating element or the second radiating element corresponds to a monopole mode, Le30 and Le40 are greater than or equal to (1/8)λ and less than or equal to (3/8)λ, where Le20 denotes an electrical length that imparts a fundamental mode of resonance to the feeding element, Le30 denotes an electrical length that imparts a fundamental mode of resonance to the first radiating element, Le40 denotes an electrical length that imparts a fundamental mode of resonance to the second radiating element, and denotes a wavelength on the feeding element or the first radiating element and the second radiating element at a resonant frequency of a fundamental mode of the first radiating element and the second radiating element.

6. The antenna according to claim 1, wherein the feeding element, the first radiating element and the second radiating element are positioned such that a shortest distance between the feeding element and the first radiating element and a shortest distance between the feeding element and the second radiating element are less than or equal to $0.2\lambda_0$, where $\lambda_0$ denotes a wavelength in vacuum at a resonant frequency of a fundamental mode of the first radiating element and the second radiating element.

7. The antenna according to claim 1, further comprising:

a matching circuit that adjusts a resonant frequency of a fundamental mode of the first radiating element and the second radiating element in cooperation with the first and second impedance variable units.

8. The antenna according to claim 1, further comprising:

a ground plane, wherein the feeding element extends in a direction away from the ground plane, and each of the first radiating element and the second radiating element includes a portion positioned along an edge of the ground plane.

9. The antenna according to claim 8, further comprising:

a plate conductor including a conductor portion spaced apart from the ground plane and facing the ground plane, wherein the first radiating element and the second radiating element are connected to the plate conductor.

10. The antenna according to claim 9, wherein the plate conductor includes a heat dissipating function.

11. An antenna device, comprising:

the antenna of claim 1 in a plurality, wherein the plurality of antennas shares a ground plane corresponding to a ground reference of the feeding point.

12. A wireless device, comprising:

the antenna of claim 1.

13. A wireless device, comprising:

the antenna of claim 1 in a plurality, wherein the plurality of antennas shares a ground plane corresponding to a ground reference of the feeding point.

14. An antenna, comprising:

a feeding element connected to a feeding point;

a first radiating element spaced apart from the feeding element by a distance set such that the first radiating element is coupled to the feeding element through electromagnetic field coupling and establishes noncontact feeding via the feeding element;

a second radiating element spaced apart from the feeding element by a distance set such that the second radiating element is coupled to the feeding element through electromagnetic field coupling and establishes noncontact feeding via the feeding element;

a first control element connected to the feeding element via a first impedance variable unit and having a high impedance portion having a high impedance at a resonant frequency of the first radiating element; and a second control element connected to the feeding element via a second impedance variable unit and having a high impedance portion having a high impedance at a resonant frequency of the second radiating element, wherein the first impedance variable unit comprises circuitry configured to adjust connection between the feeding element and the first control element, the second impedance variable unit comprises circuitry configured to adjust connection between the feeding element and the second control element, the first control element is positioned such that the high impedance portion of the first control element is positioned closer to a low impedance portion of the first radiating element having a low impedance at the resonant frequency of the first radiating element than a high impedance portion of the first radiating element having a high impedance at the resonant frequency of the first radiating element, and the second control element is positioned such that the high impedance portion of the second control element is positioned closer to a low impedance portion of the second radiating element having a low impedance at the resonant frequency of the second radiating element than a high impedance portion of the second radiating element having a high impedance at the resonant frequency of the second radiating element.

15. An antenna device, comprising:

the antenna of claim 14 in a plurality, wherein the plurality of antennas shares a ground plane corresponding to a ground reference of the feeding point.

16. A wireless device, comprising:

the antenna of claim 14.

17. A wireless device, comprising:

the antenna of claim 14 in a plurality, wherein the plurality of antennas shares a ground plane corresponding to a ground reference of the feeding point.

18. An antenna, comprising:

a ground plane;

a plate conductor including a conductor portion spaced apart from the ground plane and facing the ground plane;

a feeding element connected to a feeding point;

a first radiating element spaced apart from the feeding element by a distance set such that the first radiating element is coupled to the feeding element through electromagnetic field coupling and establishes noncontact feeding via the feeding element;

a second radiating element spaced apart from the feeding element by a distance set such that the second radiating element is coupled to the feeding element through electromagnetic field coupling and establishes noncontact feeding via the feeding element;

a first control element connected to the feeding element via a first impedance variable unit and positioned such that when the first impedance variable unit decreases an impedance at a resonant frequency of the first radiating element, the electromagnetic field coupling between the feeding element and the first radiating element is weakened and a radiating conductor function of the first radiating element is degraded; and a second control element connected to the feeding element via a second impedance variable unit and positioned such that when the second impedance variable unit decreases an impedance at a resonant frequency of the second radiating element, the electromagnetic field coupling between the feeding element and the second radiating element is weakened and a radiating conductor function of the second radiating element is degraded, wherein the feeding element extends in a direction away from the ground plane, each of the first radiating element and the second radiating element includes a portion positioned along an edge of the ground plane, the first radiating element and the second radiating element are connected to the plate conductor, the ground plane and the plate conductor are DC coupled, the first impedance variable unit comprises circuitry configured to adjust connection between the feeding element and the first control element, and the second impedance variable unit comprises circuitry configured to adjust connection between the feeding element and the second control element.

19. The antenna according to claim 18, wherein in a dipole mode, a feeding portion of each of the first radiating element and the second radiating element at which the feeding element feeds the first radiating element or the second radiating element is located at a first region spaced apart from a lowest impedance portion of the first radiating element or the second radiating element by a distance greater than or equal to ⅛ of a total length of the first radiating element or the second radiating element: in a monopole mode, the feeding portion is located at a second region spaced apart from the lowest impedance portion of the first radiating element or the second radiating element by a distance greater than or equal to ¼ of the total length of the first radiating element or the second radiating element; and in a loop mode, the feeding portion is located at a third region spaced apart from a highest impedance portion of the first radiating element or the second radiating element by a distance less than or equal to 3/16 of an inner circumference of a loop formed by the first radiating element or the second radiating element.

20. The antenna according to claim 18, wherein in a dipole mode, a distance over which the feeding element and the first radiating element or the second radiating element run parallel to each other spaced a shortest distance apart is less than or equal to ⅜ of a length of the first radiating element or the second radiating element; in a loop mode, the distance is less than or equal to 3/16 of an inner circumference of a loop formed by the first radiating element or the second radiating element; and in monopole mode, the distance is less than or equal to ¾ of the length of the first radiating element or the second radiating element.

* * * * *